US008066160B2

(12) United States Patent
Sakane et al.

(10) Patent No.: US 8,066,160 B2
(45) Date of Patent: Nov. 29, 2011

(54) FOLDING APPARATUS

(75) Inventors: Shinichi Sakane, Shiga (JP); Yoshimasa Endo, Shiga (JP); Hiroshi Kimura, Shiga (JP); Takahiro Yoshida, Shiga (JP)

(73) Assignee: I.S.T. Corporation, Shiga (JP)

( * ) Notice: Subject to any disclaimer, the term of this patent is extended or adjusted under 35 U.S.C. 154(b) by 443 days.

(21) Appl. No.: 12/438,891

(22) PCT Filed: Sep. 14, 2007

(86) PCT No.: PCT/JP2007/067955

§ 371 (c)(1),
(2), (4) Date: Feb. 25, 2009

(87) PCT Pub. No.: WO2008/032826

PCT Pub. Date: Mar. 20, 2008

(65) Prior Publication Data

US 2010/0012688 A1 Jan. 21, 2010

(30) Foreign Application Priority Data

Sep. 14, 2006 (JP) ..... 2006-248949

(51) Int. Cl.
*A41H 33/00* (2006.01)

(52) U.S. Cl. ..... 223/37

(58) Field of Classification Search ..... 223/37
See application file for complete search history.

(56) References Cited

U.S. PATENT DOCUMENTS

| | | | | |
|---|---|---|---|---|
| 3,419,199 | A * | 12/1968 | Lornitzo | 223/37 |
| 3,477,619 | A * | 11/1969 | Lee | 223/37 |
| 3,514,020 | A | 5/1970 | Lornitzo | |
| 4,277,005 | A * | 7/1981 | Heap | 223/37 |
| 5,934,523 | A * | 8/1999 | Willett et al. | 223/37 |
| 2002/0157241 | A1 * | 10/2002 | Yamamoto | 29/705 |

FOREIGN PATENT DOCUMENTS

| | | | |
|---|---|---|---|
| JP | H04-092700 | A | 3/1992 |
| JP | H08-215500 | A | 8/1996 |

* cited by examiner

*Primary Examiner* — Shaun R Hurley
(74) *Attorney, Agent, or Firm* — Global IP Counselors, LLP

(57) ABSTRACT

A mounting member, a rotation mechanism, and a plurality of plate-shaped members are included in a folding apparatus in order to simplify the configuration thereof, to make it easy to perform maintenance and repairs, and to reduce costs. The mounting member is a plate-shaped member wherein a foldable article can be mounted on a first surface so that part of the foldable article hangs down. The rotation mechanism rotates the first surface of the mounting member around an axis included in the first surface. The plurality of plate-shaped members are capable of moving toward the mourning member so as to hold part of the foldable article after part of the foldable article has been positioned in the vicinity of the mounting member due to the mounting member being rotated by the rotation mechanism.

23 Claims, 19 Drawing Sheets

FOLDING APPARATUS

CROSS-REFERENCE TO RELATED APPLICATIONS

This U.S. National stage application claims priority under 35 U.S.C. §119(a) to Japanese Patent Application No. 2006-248949, filed in Japan on Sep. 14, 2006, the entire contents of which are hereby incorporated herein by reference.

TECHNICAL FIELD

The present invention relates to a folding apparatus for folding foldable articles, a conveying apparatus for conveying folded articles that have been folded, and a method for folding foldable articles.

BACKGROUND ART

In establishments such as cleaning stores whose business is cleaning, a large amount of foldable articles such as shirts must be folded. In view of this, apparatuses for folding numerous foldable articles have been considered.

For example, an existing example of an apparatus for folding shirts as foldable articles is a folding apparatus comprising a shirt-mounting base for mounting a shirt, a plurality of plate-shaped members for folding a part of a shirt, the plate-shaped members being capable of moving relative to the shirt-mounting base from a space below and to the side of the shirt-mounting base to a space below the shirt-mounting base, and a photoelectric sensor for sensing the positions of the sleeves or the like of the shirt (see Japanese Laid-open Patent Application No. 8-215500).

With this shirt-folding apparatus, an operator mounts shirts on the shirt-mounting base so that the sleeves or the like hang down from the shirt-mounting base. When a shirt is mounted on the mounting base, the positions of the sleeves or the like of the shirt are recognized by the photoelectric sensor, the plurality of plate-shaped members are moved relative to the shirt and the shirt-mounting base to a space below the mounting base so as to fold the sleeves of the shirt, and the shirt is folded.

SUMMARY OF THE INVENTION

Problems the Invention is Intended to Solve

In the shirt folding apparatus disclosed in Japanese Laid-open Patent Application No. 8-215500, when the plurality of plate-shaped members are moved relative to the shirt and the shirt-mounting base from a space below and to the side of the shirt-mounting base to a space below the shirt-mounting base in order to fold the sleeves or the like of the shirt, part of the shirt is pulled by the ends of the plate-shaped members on the sides in the movement direction. At this time, the shirt is damaged due to the shirt being pulled.

The shirt is also damaged because when the plate-shaped members move, the shirt and the plate-shaped members slide relative to each other. Therefore, the shirt is readily damaged.

Furthermore, a mechanism for sliding the plurality of plate-shaped members must be provided, and the configuration becomes complicated. A photoelectric sensor or the like must also be provided in order to confirm the positions of the sleeves or the like, and the cost increases.

An object of the present invention is to ensure that a shirt or another foldable article is not readily subjected to damage or stress when a foldable article such as a shirt is folded. It is also an object to simplify the configuration of the folding apparatus and to make maintenance and repairs easier to perform and less expensive.

Means for Resolving these Problems

The folding apparatus according to a first aspect comprises a mounting member, a rotation mechanism, and plate-shaped members. The mounting member is a member on which a foldable article can be mounted on a first surface so that part of the foldable article hangs down. The rotation mechanism rotates the first surface of the mounting member around an axis included in the first surface. The plurality of plate-shaped members are capable of moving toward the mounting member so that part of the foldable article is held, after part of the foldable article is positioned in proximity to the mounting member by the rotation of the mounting member with the rotation mechanism.

In this folding apparatus, the foldable article, e.g., a shirt is mounted on the first surface of the mounting member so that part of the shirt (a sleeve or the like) hangs down from the mounting member. The mounting member is then rotated by the rotation mechanism so as to be inclined substantially 90° from its initial state. At this time, the foldable article is spread between the vicinities of the first and second surfaces of the mounting member, i.e., the part hanging down from the mounting member due to gravity becomes positioned in the vicinity of the other surface of the mounting member. In this state, a plate-shaped member moves toward the mounting member, and part of the foldable article is held between the mounting member and the plate-shaped member. When, for example, the mounting member is thereafter rotated again by the rotation mechanism 180° in the opposite direction of which the mounting member first rotated, part of the foldable article moves to the vicinity of the surface of the plate-shaped member on the side opposite the side facing the mounting member. At this time, another plate-shaped member moves toward the mounting member, this plate-shaped member being different from the one that has already moved toward the mounting member, and part of the foldable article is held by the surface of the plate-shaped member on the side opposite the surface facing the mounting member. In this manner, the foldable article continues to be held sequentially by two plate-shaped members from the plurality of plate-shaped members, and the foldable article is folded.

In this configuration, when the mounting member is rotated by the rotation mechanism, e.g., the sleeve of the shirt, part of a towel, or the like is spread over the vicinity of the first surface of the mounting member and the vicinity of the second surface on the opposite side of the first surface, and part of the foldable article in the vicinity of the second surface is held between two plate-shaped members. Therefore, the shirt is not pulled and the shirt and plate-shaped members do not slide when the shirt or the like is folded, and the shirt is not readily subjected to damage or stress. There is also no need to precisely detect the positions of the shirt sleeves or the like. Therefore, there is no need for a photoelectric sensor, and costs can be suppressed. The configuration can be simplified, and maintenance and repairs are easily performed.

The folding apparatus according to a second aspect is the folding apparatus according to the first aspect, wherein the plurality of plate-shaped members are turnably fixed at one end to the mounting member, and the folding apparatus further comprises a turning mechanism for turning the plate-shaped members toward the mounting member at a predetermined timing.

The foldable article can be folded by the plurality of plate-shaped members and the mounting-member by turning the plurality of plate-shaped members toward the mounting member. Therefore, there is no need for a mechanism for sliding the plate-shaped members to the space below the mounting member, and the configuration can be simplified.

The folding apparatus according to a third aspect is the folding apparatus according to the first or second aspect, wherein the turning angle of the plurality of plate-shaped members in relation to the mounting member is 90° or less.

The foldable article can be folded by the plurality of plate-shaped members and the mounting member by turning the plurality of plate-shaped members toward the mounting member. Therefore, there is no need for a mechanism for sliding the plate-shaped members to the space below the mounting member, and the configuration can be simplified.

The folding apparatus according to a fourth aspect is the folding apparatus according to any of the first through third aspects, further comprising: a conveying apparatus having a holding mechanism for holding a folded article as a foldable article that has been folded, and a folded article movement mechanism for conveying the folded article held by the holding mechanism from the mounting member to a predetermined position.

In this folding apparatus, the folded article is held by the holding mechanism, and the folded article is conveyed to a predetermined position by the folded article movement mechanism.

The folding apparatus according to a fifth aspect comprises a plate member, a rotation mechanism, a plurality of plate-shaped members, and a turning mechanism. The plate member is a member in the shape of a plate. The rotation mechanism is placed at an end of the plate member, and the rotation mechanism rotates a first surface of the plate member around an axis included in the first surface. The plurality of plate-shaped members are rotated by the rotation mechanism and are attached in the vicinity of the lateral end of the plate member where the rotation mechanism is placed, the plurality of plate-shaped members being capable of turning relative to the plate member. The turning mechanism turns the plurality of plate-shaped members relative to the plate member.

In this folding apparatus, an operator mounts a foldable article such as a shirt on the plate member so that a part (e.g., a sleeve) protrudes out from the plate member; i.e., so that a part of the foldable article hangs down from the plate member. The rotation mechanism rotates the first surface of the plate member around an axis included in the first surface. At this time, one plate-shaped member from among the plurality of plate-shaped members is caused to turn by the turning mechanism when the foldable article becomes spread to one end of the plate member. At this time, the foldable article is folded while being held between the plate member and the plate-shaped member. The plate member and the plate-shaped member are then caused to rotate further by the rotation mechanism, and part of the foldable article hangs down in the vicinity of the surface of the plate-shaped member on the side opposite the side facing the plate member. In this state, a plate-shaped member other than the plate-shaped member facing the plate member is caused to turn, and the foldable article is held and folded between this plate-shaped member and the plate-shaped member facing the plate member. This type of operation is repeated to continue to fold foldable articles such as shirts.

In this configuration, when the plate member is rotated by the rotation mechanism, e.g., the shirt sleeve or towel or the like is spread over the vicinity of the first surface of the plate member and the vicinity of the second surface on the side opposite the first surface, and part of the foldable article in the vicinity of the other surface is folded while being held between two plate-shaped members. Therefore, when the shirt or the like is folded, the shirt is not pulled and the shirt and plate-shaped members do not slide against each other, and it is possible to ensure that the shirt is not readily subjected to damage or stress. There is also no need to precisely detect the position of the shirt sleeve or the like. Therefore, there is no need for a photoelectric sensor, and costs can be suppressed. The configuration can be simplified, and maintenance and repairs are easy to perform.

The folding apparatus according to a sixth aspect is the folding apparatus according to the fifth aspect, wherein the rotation mechanism and the turning mechanism are operated by a single drive source.

Since the rotation mechanism and the turning mechanism are operated by a single drive source, it is possible to prevent an increase in the number of drive sources, and to reduce space and cost.

The folding apparatus according to a seventh aspect is the folding apparatus according to the sixth aspect, wherein the turning mechanism turns the plurality of plate-shaped members at a turning angle of 90° or less relative to the plate member.

Turning the plurality of plate-shaped members toward the plate member makes it possible for the foldable article to be folded by the plurality of plate-shaped members and the plate member.

The folding apparatus according to an eighth aspect is the folded apparatus according to any of the fifth through seventh aspects, wherein the plurality of plate-shaped members are turnably connected at one end to the plate member.

Part of the foldable article can be folded by turning the plurality of plate-shaped members around the portion connected to the plate member.

The folding apparatus according to a ninth aspect is the folding apparatus according to any of the fifth through eighth aspects, further comprising a conveying apparatus including a holding mechanism having a first holding member placed below the folded article, a second holding member placed above the folded article so as to face the first holding member, the second holding member and the first holding member being capable of holding the folded article therebetween, and a holding member movement mechanism for moving the first holding member and the second holding member toward the folded article, and further including a folded article movement mechanism for moving the folded article to a predetermined position; and a stacking device for stacking the folded article conveyed by the conveying apparatus.

In this folding apparatus, the first holding member is placed below the folded article while the second holding member is placed above the folded article, the first holding member and second holding member are moved toward the folded article by the holding member movement mechanism, and the folded article is held by the first holding member and the second holding member. The folded article is then conveyed by the folded article movement mechanism. The folded article is then stacked by the stacking device.

The folded article can thus be conveyed to a predetermined position and stacked.

The folding apparatus according to a tenth aspect is the folding apparatus according to the ninth aspect, wherein the plate member and the plurality of plate-shaped members have cutouts through which at least one of the first holding member and the second holding member can pass when the plate member and the plurality of plate-shaped members are superposed together.

The folded article that has been folded by the mounting member and the plurality of plate-shaped members is easily held by the first and second holding members.

The folding apparatus according to an eleventh aspect is the folding apparatus according to the ninth or tenth aspect, wherein the stacking device has a stacking structure whose height position varies according to the weight of the folded article.

Since the height position of the stacking device varies according to the weight of the folded article, a greater amount of folded articles can be stacked. Specifically, as the amount of folded articles become heavier by increasing the folded articles, the height position lowers according to the weight of the folded articles, and the space increases in which new folded articles can be accommodated and stacked.

The folding apparatus according to a twelfth aspect is the folding apparatus according to any of the ninth through eleventh aspects, wherein the folded article movement mechanism has a plate-shaped folded article mounting member on which the folded articles can be mounted, rod-shaped members attached to both ends of the folded article mounting member, the rod-shaped members being longer than the width of the folded article mounting member, and guide members for guiding the rod-shaped members so that the folded article mounting member moves between a mounting position where folded articles are mounted on the folded article mounting member, and a stacking position where the folded articles mounted on the folded article mounting member are stacked at a predetermined position.

In this folding apparatus, the rod-shaped members are guided between the mounting position and the stacking position in a state in which the folded articles have been mounted on the conveyed article mounting member.

The conveying apparatus according to a thirteenth aspect comprises a first holding member placed below a conveyed article, a second holding member placed above the conveyed article so as to face the first holding member, the second holding member and the first holding member being capable of holding the conveyed article therebetween, a holding member movement mechanism for moving the first holding member and the second holding member toward the conveyed article, and a conveyed article movement mechanism for moving the conveyed article to a predetermined position.

In this conveying apparatus, the first holding member is placed below the conveyed article while the second holding member is placed above the conveyed article, the first holding member and second holding member are moved toward the conveyed article by the holding member movement mechanism, and the conveyed article is held. The conveyed article is then conveyed by the conveyed article movement mechanism.

The conveyed article can herein be conveyed to a predetermined position.

The folding method according to a fourteenth aspect comprises a first step for mounting a foldable article on a plate-shaped mounting member on which the foldable article can be mounted; a second step for rotating the mounting member and thereby positioning a first folded part in the vicinity of the surface of the mounting member on the side where the foldable article is not mounted, the first folded part being part of the foldable article mounted on the mounting member; a third step for moving a flat first plate-shaped member so as to hold the first folded part between the mounting member and the flat first plate-shaped member; a fourth step for rotating the mounting member and thereby positioning a second folded part in the vicinity of the surface of the first plate-shaped member on the side opposite the mounting member, the second folded part being a different part of the foldable article than the first folded part; a fifth step for moving a flat second plate-shaped member so as to hold the second folded part between the flat first plate-shaped member and the flat second plate-shaped member; a sixth step for rotating the mounting member and thereby positioning a third folded part in the vicinity of the surface of the second plate-shaped member on the side opposite the first plate-shaped member, the third folded part being a different part of the foldable article than the first folded part and the second folded part; and a seventh step for moving a flat third plate-shaped member so as to hold the third folded part between the second plate-shaped member and the flat third plate-shaped member.

In this folding method, the foldable article is mounted on the mounting member, and the mounting member is rotated, thereby positioning the first folded part in the vicinity of the surface of the mounting member on the side where the foldable article is not mounted. The first plate-shaped member then moves toward the mounting member and the first folded part is held between the mounting member and the first plate-shaped member, whereby the first folded part is folded. The mounting member is then rotated, thereby positioning the second folded part in the vicinity of the surface of the first plate-shaped member on the side opposite the mounting member, and the second folded part is folded while being held between the first plate-shaped member and the second plate-shaped member. The mounting member is then rotated, thereby placing the third folded part in the vicinity of the surface of the second plate-shaped member on the side opposite the first plate-shaped member. At this time, the third plate-shaped member moves toward the second plate-shaped member, and folds the third folded part while holding the third part between the second plate-shaped member and the third plate-shaped member.

The foldable article can herein be folded by the mounting member and the three plate-shaped members.

The folding method according to a fifteenth aspect is the folding method according to the fourteenth aspect, wherein the mounting member is turned 90° or more in the second step, the fourth step, and the sixth step, thereby positioning the folded part in the vicinity of the surface of the mounting member on the opposite side of where the foldable article is placed, the folded part being part of the foldable article mounted on the mounting member.

In cases in which the mounting member is rotated only 90° or less than 90°, part of the foldable article 81 bends, as does the distal end of the mounting member 82 in particular, as shown in FIG. 33. In this state, wrinkles form in the first folded part when the foldable article 81 is held by the mounting member 82 and the plate-shaped member, and the foldable article cannot be folded neatly.

The foldable article 81 can be prevented from bending between the mounting member 82 and the plate-shaped member by turning the mounting member 82 by 90° or more, as shown in FIG. 34. Therefore, the foldable article can be folded neatly.

The folding apparatus according to a sixteenth aspect is the folding apparatus according to any of the first through fourth aspects, wherein the width of the mounting member can be adjusted according to the shape of the foldable article, and the positions of the plurality of plate-shaped members can be adjusted according to the shape of the foldable article.

Since the width of the mounting member can be adjusted according to the shape, i.e., the size and shape of the foldable article, various types of foldable articles can be folded.

The folding apparatus according to a seventeenth aspect is the folding apparatus according to any of the first through fourth and sixteenth aspects, wherein the mounting member and the plurality of plate-shaped members are capable of generating heat and supplying steam to the foldable article.

Since the mounting member and the plurality of plate-shaped members are capable of generating heat and of supplying steam to the foldable article, it is possible to readily smooth out wrinkles in the foldable article.

The folding apparatus according to an eighteenth aspect is the folding apparatus according to any of the first through fourth, sixteenth, and seventeenth aspects, wherein the plurality of plate-shaped members are placed at a predetermined distance away from the mounting member, and are bent so as to hold the foldable article from the distal end sides between the mounting member and the plate-shaped members.

In cases in which the foldable article 83 is thick, the distal end side 831 of the foldable article 83 is not held between the mounting member 84 and the plurality of plate-shaped members 85, as shown in FIG. 35.

The distal end sides of the plurality of plate-shaped members 85 are bent, and the distal end of the foldable article 83 can be held. Therefore, even a thick article can be folded.

The folding apparatus according to a nineteenth aspect is the folding apparatus according to any of the fifth through twelfth aspects, wherein the width of the plate member can be adjusted according to the shape of the foldable article, and the positions of the plurality of plate-shaped members can be adjusted according to the shape of the foldable article.

Since the width of the plate member can be adjusted according to the shape, i.e., the size and shape of the foldable article, various types of foldable articles can be folded.

The folding apparatus according to a twentieth aspect is the folding apparatus according to any of the fifth through twelfth and nineteenth aspects, wherein the plate member and the plurality of plate-shaped members are capable of generating heat and supplying steam to the foldable article.

Since the plate member and the plurality of plate-shaped members are capable of generating heat and of supplying steam to the foldable article, it is easy to smooth out wrinkles in the foldable article.

The folding apparatus according to a twenty-first aspect is the folding apparatus according to any of the fifth through twelfth, nineteenth, and twentieth aspects, wherein the plurality of plate-shaped members are placed at a predetermined distance away from the plate member, and are bent so as to hold the foldable article from the distal end sides between the plate member and the plurality of plate-shaped members.

The plurality of plate-shaped members can be bent at arbitrary portions, and the distal end of the foldable article can be held.

The folding apparatus according to a twenty-second aspect is the folding apparatus according to any of the first through twelfth, sixteenth, seventeenth, eighteenth, nineteenth, twentieth, and twenty-first aspects, wherein the plurality of plate-shaped members can be elastically deformed.

It is herein even easier for the foldable article to be held between the mounting member and the plurality of plate-shaped members.

The mounting apparatus according to a twenty-third aspect is a mounting apparatus for setting a foldable article on a mounting member on which foldable articles can be mounted, the mounting apparatus comprising a gripping member for gripping one end of the foldable article, wherein the gripping member mounts the foldable article on the mounting member by advancing in one direction while gradually moving from the space above the mounting member to the space below.

In cases in which the foldable article has creases or wrinkles when the foldable article is mounted on the mounting member, the foldable article cannot be folded neatly when folded.

It is herein easy to mount the foldable article on the mounting member so that wrinkles do not form. Specifically, since the gripping member moves in one direction of the mounting member while being lowered, the positions of the mounting member and gripping member approach each other, and wrinkles or creases do not readily form.

Effect of the Invention

In the present invention, when a foldable article such as a shirt is folded, it is possible to ensure that the foldable article such as a shirt will not be readily subjected to damage or stress. The configuration of the folding apparatus can be simplified, maintenance and repairs can be performed easily, and costs can be reduced.

DETAILED DESCRIPTION OF THE INVENTION

First Embodiment

1. Overall Configuration

Figure 1:
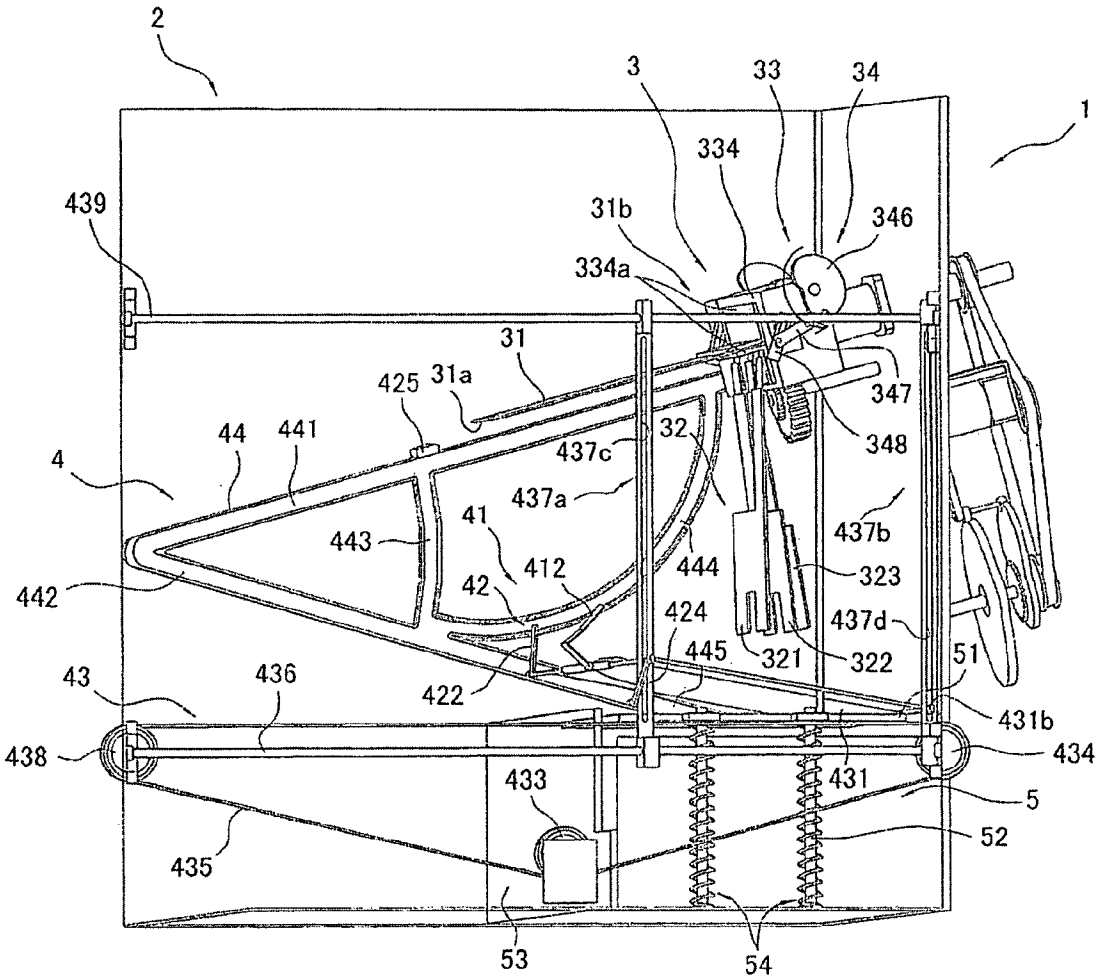
FIG. 1 is an overall cross-sectional view of a folding apparatus according to an embodiment of the present invention.

FIG. 1 shows a folding apparatus 1 according to the first embodiment of the present invention. The folding apparatus 1 is an apparatus for folding foldable articles, e.g., shirts, towels, or the like, and the apparatus comprises a frame 2, a folding part 3, a conveyor 4, and a stacking part 5.

2. Frame

The frame 2 is a portion for supporting the folding part 3, the conveyor 4, and other components, and is a substantially cubical portion. An opening is placed in the portion corresponding to the location where the stacking part 5 is placed.

3. Folding Part

The folding part 3 is a portion for folding shirts and the like as foldable articles, and the folding part 3 comprises a mounting member 31 (a mounting member or a plate member), a plurality of plate-shaped members 32, a rotation mechanism 33, and a turning mechanism 34. The folding part 3 is placed at the top of the entire device, and is supported on the frame 2.

The mounting member 31 is a member where foldable articles such as shirts can be placed, and is a substantially rectangular plate-shaped member. The mounting member 31 is provided so that a first end 31*a* in the longitudinal direction is positioned lower than a second end 31*b* on opposite side of the first end 31*a*; i.e., the mounting member 31 is placed at an incline at a predetermined angle, and the second end 31*b* side is fixed to a base plate 334 of the rotation mechanism 33. Furthermore, a rectangular cutout 311 (see FIG. 7) is provided in the middle of the first end of the mounting member 31.

The plurality of plate-shaped members 32 are members for folding the foldable articles in steps, and the plate-shaped members 32 include a first plate-shaped member 321, a second plate-shaped member 322, and a third plate-shaped member 323. The plurality of plate-shaped members 32 are rotatably attached at one end in proximity to the second end 31*b* of the mounting member 31.

Figure 2:
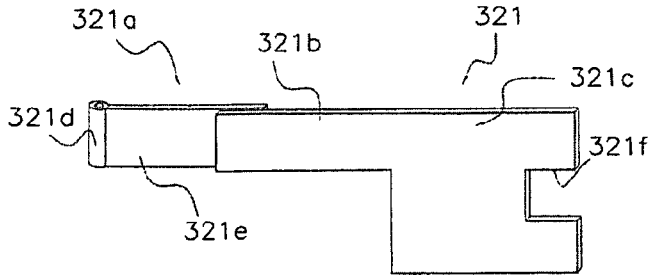
FIG. 2 is a view showing the first plate-shaped member.

The first plate-shaped member 321 has a first connecting part 321*a*, a first supporting part 321*b*, and a first holding plate-shaped part 321*c*, as shown in FIG. 2, and the first plate-shaped member 321 is disposed in a direction substantially orthogonal to the direction in which the mounting member 31 extends before a foldable article is held between the mounting member 31 and the first plat-shaped member. The first connecting part 321*a* has a first cylindrical connecting part 321*d* shaped as a cylinder, and a first connecting plate 321*e* protruding diametrically outward from the first cylindrical connecting part 321*d* and having a plate shape of substantially the same width as the longitudinal width of the first cylindrical connecting part 321*d*. Inserted through the first cylindrical connecting part 321*d* is a first turning shaft 349 (see FIG. 7), described hereinafter, for turning the first plate shaped member 321. The first supporting part 321*b* is a portion connected to the first connecting part 321*a* on the opposite end of where the first cylindrical connecting part 321*d* is placed, and is also a plate-shaped portion extending to a side opposite of the side in which the first connecting part 321*a* is disposed. The first supporting part 321*b* has approximately one third the width of the first holding plate-shaped part 321*c*, and is placed at the left (the top in FIG. 2) end of the width direction of the first holding plate-shaped part 321*c*, as seen from the first connecting plate 321*e* in a state in which the first connecting part 321*a* is placed underneath the first supporting part 321*b*. The first holding plate-shaped part 321*c* is a substantially rectangular portion, and foldable articles are held between the mounting member 31 or the second plate-shaped member 322 and the first holding plate-shaped part. The first holding plate-shaped part 321*c* is connected at one end to the end of the first supporting part 321*b* opposite the end where the first connecting plate 321*e* is placed, and provided in the center of the other end is a first cutout 321*f* of the same shape as the cutout 311 of the mounting member 31. Furthermore, the first holding plate-shaped part 321*c* is substantially equal in width to the mounting member 31, the width of which is orthogonal to the longitudinal direction.

Figure 3:
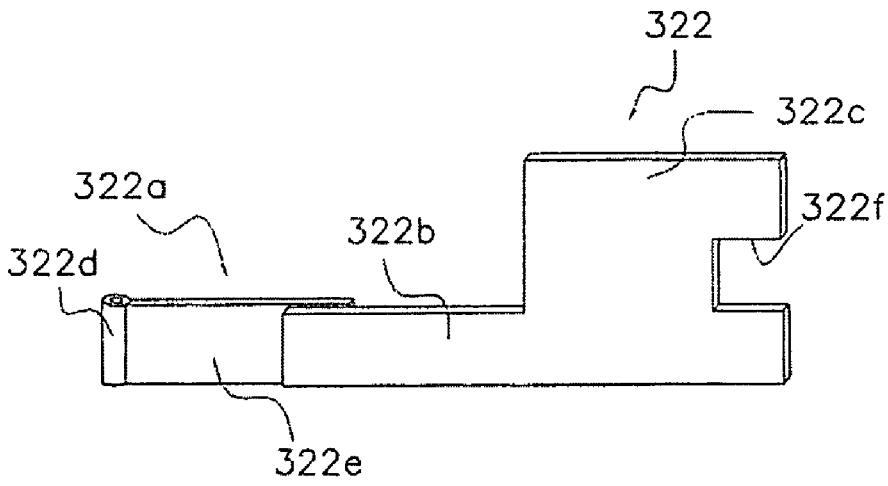
FIG. 3 is a view showing the second plate-shaped member.

The second plate-shaped member 322 has a second connecting part 322*a*, a second supporting part 322*b*, and a second holding plate-shaped part 322*c*, as shown in FIG. 3, and the second plate-shaped member 322 is disposed so as to extend in a direction substantially orthogonal to the direction in which the mounting member 31 extends. The second connecting part 322*a* has a second cylindrical connecting part 322*d* shaped as a cylinder, and a second connecting plate 322*e* protruding diametrically outward from the second cylindrical connecting part 322*d* and having a plate shape of substantially the same width as the longitudinal width of the second cylindrical connecting part 322*d*. Inserted through the second cylindrical connecting part 322*d* is a second turning shaft 353 (see FIG. 7), described hereinafter, for turning the second plate-shaped member 322. The second supporting part 322*b* is a portion connected to the second cylindrical connecting part 322*d* of the second connecting part 322*a*, and is also a plate-shaped portion extending to the side opposite the side in which the second cylindrical connecting part 322*d* of the second connecting part 322*a* is disposed. The second supporting part 322*b* has approximately one third the width of the second holding plate-shaped part 322*c*, and is placed at the right (the bottom in FIG. 3) end of the width direction of the second holding plate-shaped part 322*c*, when the second connecting part 322*a* is placed underneath the second supporting part 322*b* and viewed from the second cylindrical connecting part 322*d*. The second holding plate-shaped part 322*c* is a substantially rectangular portion, and part of the foldable article is held between the first plate shaped member 321 or the third plate-shaped member 323 and the second holding plate-shaped part. The second holding plate-shaped part 322*c* is connected at one end to the lateral end of the second supporting part 322*b* opposite the lateral end where the second connecting plate 322*e* is placed, and provided in the center of the other end is a second cutout 322*f* of the same shape as the first cutout 321*f* and the cutout 311 of the mounting member. Furthermore, the second holding plate-shaped part 322*c* is substantially equal in width to the mounting member 31, the width of which is orthogonal to the longitudinal direction.

Figure 4:
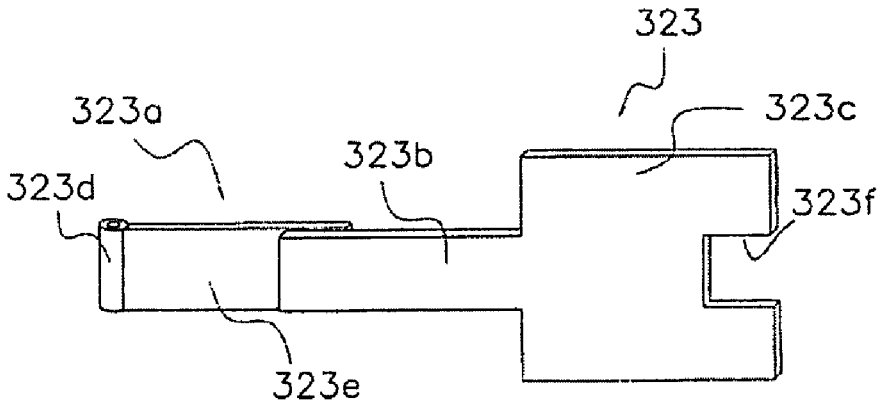
FIG. 4 is a view showing the third plate-shaped member.

The third plate-shaped member 323 has a third connecting part 323*a*, a third supporting part 323*b*, and a third holding plate-shaped part 323*c*, as shown in FIG. 4, and the third plate-shaped member 323 is disposed extending in a direction substantially orthogonal to the direction in which the mounting member 31 extends. The third connecting part 323*a* has a third cylindrical connecting part 323*d* shaped as a cylinder, and a third connecting plate 323*e* protruding diametrically outward from the third cylindrical connecting part 323*d* and having a plate shape of substantially the same width as the longitudinal width of the third cylindrical connecting part 323*d*. Inserted through the third cylindrical connecting part 323*d* is a third turning shaft 357 (see FIG. 7), described hereinafter, for turning the third plate-shaped member 323. The third supporting part 323*b* is a portion connected to a third connecting plate 323*f*, and is also a plate-shaped portion extending to the opposite side of the third cylindrical connecting part 323*e*. The third supporting part 323*b* has approximately one third the width of the third holding plate-shaped part 323*c*, and is placed in the middle of the width direction of the third holding plate-shaped part 323*c*. The third holding plate-shaped part 323*c* is a substantially rectangular portion, and part of the foldable article is held between the second plate-shaped member 322 and the third holding plate-shaped part. The third holding plate-shaped part 323*c* is connected at one end to the end of the third supporting part 323*b* opposite the end where the third connecting plate 323*f* is placed, and provided in the center of the other end is a third cutout 323*f* of the same shape as the cutout 311 of the mounting member 31, the first cutout 321*f*, and the second cutout 322*f*. Furthermore, the third holding plate-shaped part 323*c* is substantially equal in width to the mounting member 31, the width of which is orthogonal to the longitudinal direction.

The first plate-shaped member 321, the second plate-shaped member 322, and the third plate-shaped member 323 are placed so that the first holding plate-shaped part 321*c*, the second holding plate-shaped part 322*c*, and the third holding plate-shaped part 323*c* overlap each other, and are also placed in alignment so that the first cylindrical connecting part 321*d*, the second cylindrical connecting part 322*d*, and the third cylindrical connecting part 323*d* overlap each other in the stated order from the mounting member 31. Therefore, a single shaft member can be inserted in one direction through the first cylindrical connecting part 321*d*, the second cylindrical connecting part 322*d*, and the third cylindrical connecting part 323*d*.

Figure 5:
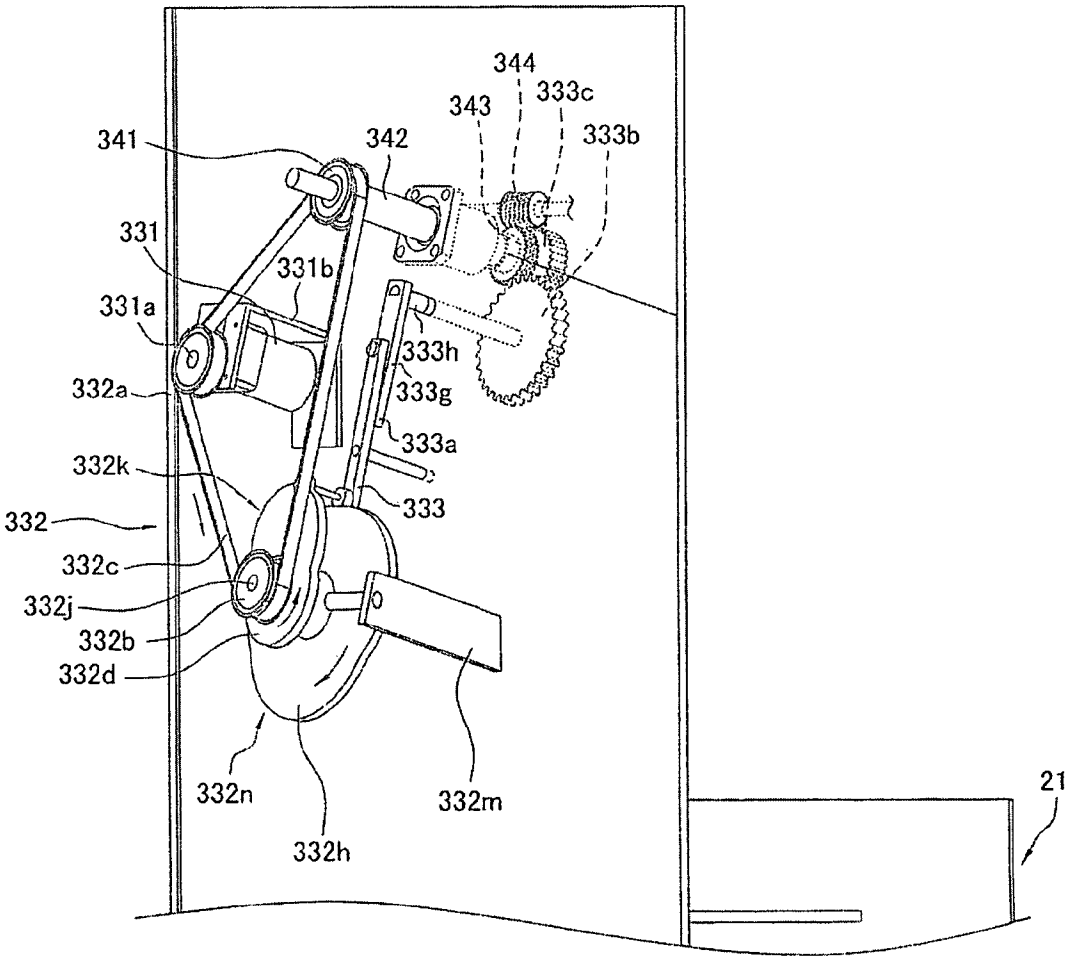
FIG. 5 is a view showing the turning mechanism and the rotation mechanism.
Figure 6:
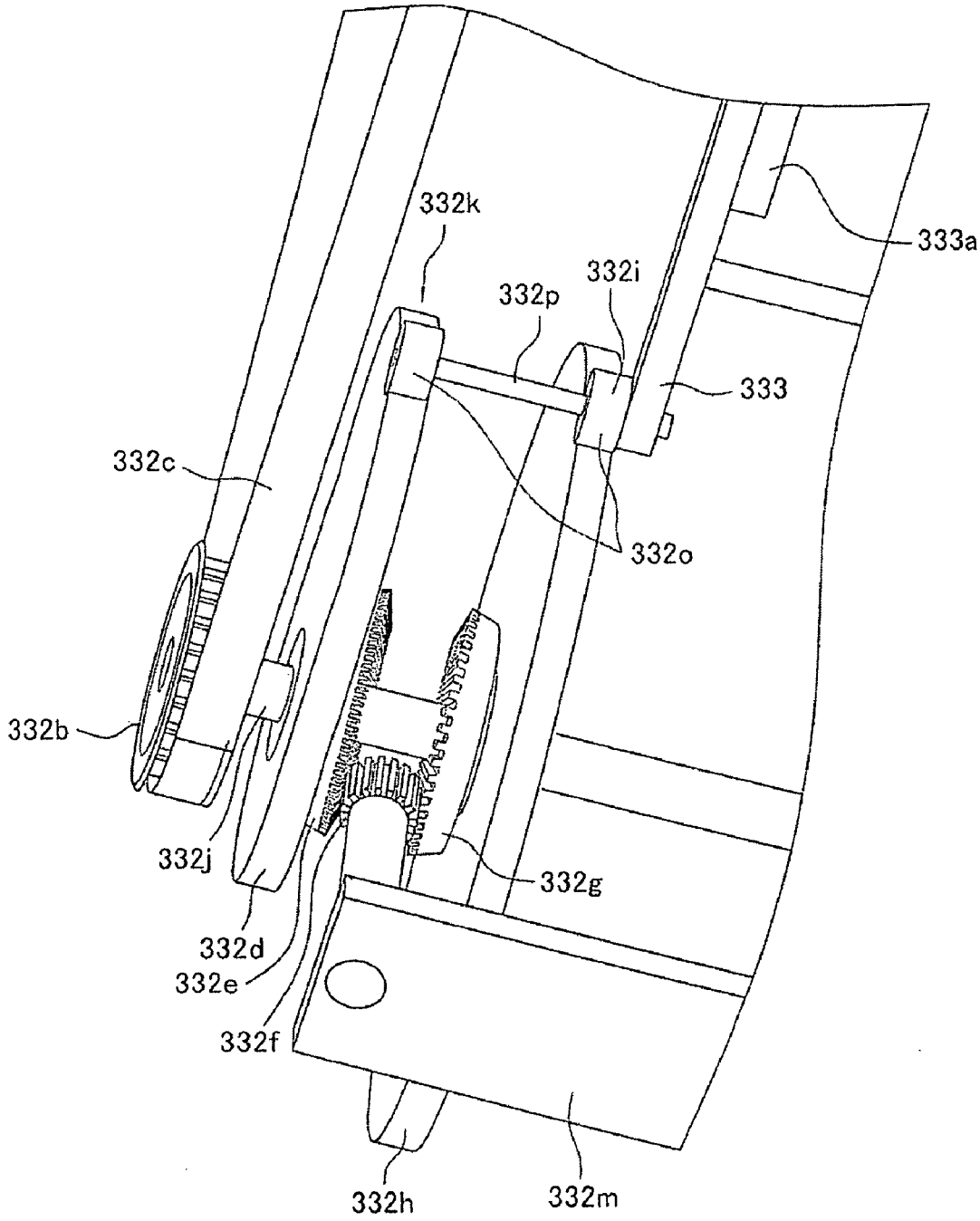
FIG. 6 is a detailed view of a portion of the rotation mechanism.
Figure 7:
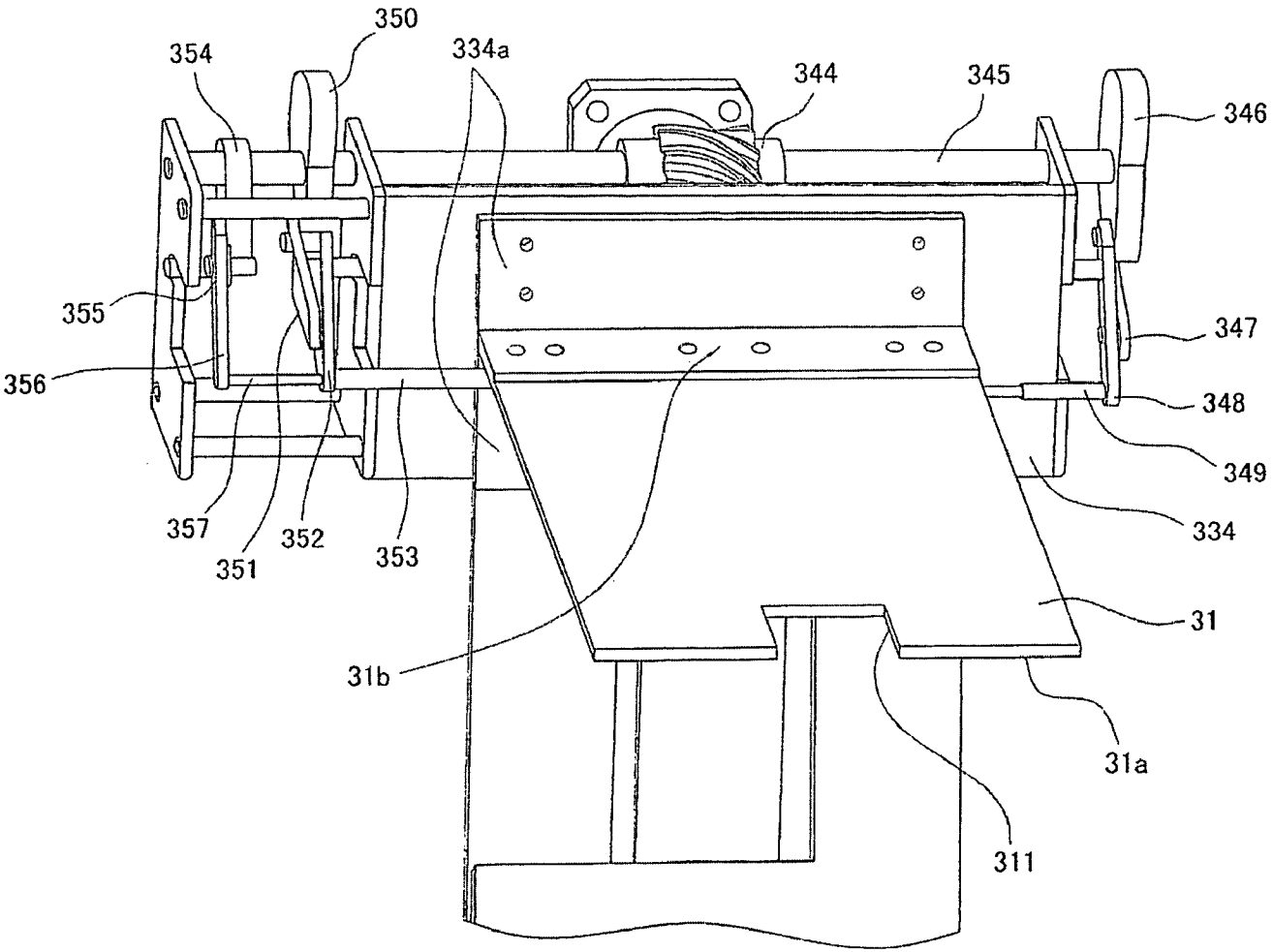
FIG. 7 is a view showing part of the turning mechanism.

The rotation mechanism 33 is a mechanism for rotating around a shaft extending along the longitudinal direction of the mounting member 31, and is placed at the other end of the mounting member 31. The rotation mechanism 33 has a first drive motor 331, a power transmission mechanism 332, and a base plate 334, as shown in FIGS. 5 through 7.

The first drive motor 331 is a member supported on the frame 2 via a drive motor support member 331*b*, and is also a member for generating power for rotating the mounting member 31 and the plurality of plate-shaped members 32. The first drive motor 331 is provided with a drive shaft 331*a*, and a first pulley 332*a*, described hereinafter, of the power transmission mechanism 332 is connected to the drive shaft 331*a*. The drive motor support member 331*b* is a member formed into a substantial U shape, one end of which is fixed to the frame 2.

The power transmission mechanism 332 is a mechanism for transmitting the power of the first drive motor 331 to the base plate 334, and the power transmission mechanism 332 comprises a first pulley 332*a*, a second pulley 332*b*, a transmission belt 332*c*, a first transmission cam 332*d*, a first bevel gear 332*e*, an intermediate transmission gear 332*f*, a second bevel gear 332*g*, a second transmission cam 332*h*, a dumbbell-shaped member 332*i*, a first intermediate transmission member 333, a second intermediate transmission member 333*a*, a first rotating gear 333*b*, and a second rotating gear 333*c*. The first pulley 332*a*, the second pulley 332*b*, the transmission belt 332*c*, the first transmission cam 332*d*, the first bevel gear 332*e*, the intermediate transmission gear 332*f*, the second bevel gear 332*g*, the second transmission cam 332*h*, the dumbbell-shaped member 332*i*, the first intermediate transmission member 333, and part of the second intermediate transmission member 333*a* of the power transmission mechanism 332 are placed outside of the frame 2. The first pulley 332*a* is a member caused to rotate by the first drive motor 331, and is also a discoid member having a groove in the external periphery capable of supporting the transmission belt 332*c*. The second pulley 332*b* is a discoid member similar to the first pulley 332*a*, and is also a member placed underneath the first pulley 332*a*. The transmission belt 332*c* is a member for transmitting the power of the first pulley 332*a* to the second pulley 332*b* and to a third pulley 341, described hereinafter, and is also an endless belt-shaped member. The transmission belt 332*c* is a member installed over the first pulley 332*a*, the second pulley 332*b*, and the third pulley 341, and power is transmitted from the first pulley 332*a*, and the belt is circulated when the first pulley 332*a* is rotated. The first transmission cam 332*d* is a member to which a shaft (second pulley-rotating shaft 332*j*) of the second pulley 332*b* is provided, and is a substantially elliptical plate-shaped member. The first transmission cam 332*d* rotates counterclockwise in FIG. 5 according to the rotation of the second pulley 332*b*. The first bevel gear 332*e* is a member provided coaxially with the first transmission cam 332*d*, and is caused to rotate in the same direction as the first transmission cam 332*d* according to the rotation of the second pulley-rotating shaft 332*j*. The intermediate transmission gear 332*f* is a gear meshed with the first bevel gear 332*e*, and is supported by a support member 332*m* extending from the frame 2. The second bevel gear 332*g* is a gear meshed with the intermediate transmission gear 332*f*, and the second bevel gear 332*g* rotates in the direction opposite the rotational direction of the first bevel gear 332*e*. The second transmission cam 332*h* is a member attached to the second bevel gear 332*g*, and is a substantially circular cam. The second transmission cam 332*h* rotates in the opposite direction of the first transmission cam 332*d*, i.e., clockwise in FIG. 5. The portion of the first transmission cam 332*d* where the distance from the second pulley-rotating shaft 332*j* is farthest (hereinbelow, the first transmission farthest portion 332*k*) is farther than the portion of the second transmission cam 332*h* where the distance from the second pulley-rotating shaft 332*j* is farthest (hereinbelow, the second transmission farthest portion 332*n*). The dumbbell-shaped member 332*i* has two columnar portions 332*o*, and a rod-shaped part 332*p* for joining two columnar portions 332*o*, and the two columnar portions 332*o* are respectively in contact with at least one of the first transmission cam 332*d* and the second transmission cam 332*h*. The rod-shaped part 332*p* of the dumbbell-shaped member 332*i* is connected at one end to the end of the first intermediate transmission member 333. When the vicinity of the first transmission farthest portion 332*k* of the first transmission cam 332*d* is positioned near the dumbbell-shaped member 332*i*, the dumbbell-shaped member 332*i* is in contact with the first transmission cam 332*d*. Otherwise, when the vicinity of the first transmission farthest portion 332*k* of the first transmission cam 332*d* is not positioned near the dumbbell-shaped member 332*i*, the second transmission cam 332*h* is in contact with the dumbbell-shaped member 332*i*. When in contact with the second transmission cam 332*h*, the dumbbell-shaped member 332*i* is caused to rotate counterclockwise in FIG. 5 according to the rotation of the second transmission cam 332*h*. When in contact with the first transmission cam 332*d*, the dumbbell-shaped member 332*i* is caused to rotate clockwise in FIG. 5 according to the rotation of the first transmission cam 332*d*. The first intermediate transmission member 333 is a T-shaped member, part of which is supported on the frame 2. The second intermediate transmission member 333*a* has a plate-shaped portion 333*g* and a shaft 333*h* provided at the end of the plate-shaped portion 333*g*, and one end of the first intermediate transmission member 333 is connected to the second intermediate transmission member 333*a*. A substantially elliptical hole is opened in the portion where the first intermediate transmission member 333 is connected, and a shaft provided at the end of the first intermediate transmission member 333 is placed in the hole. The first intermediate transmission member 333 is capable of rotating relative to the second intermediate transmission member 333*a*. The first rotating gear 333*b* is a gear attached to the end of the shaft 333*h* of the second intermediate transmission member 333*a*. The second rotating gear 333*c* is a gear member meshed with the first rotating gear 333*b*.

The base plate 334 is a plate-shaped member attached to the second rotating gear 333*c*, and is also a member caused to rotate according to the rotation of the second rotating gear 333*c*. The base plate 334 is a plate-shaped member formed into the shape of a U. Two support members 334*a* formed by bending plates into L shapes are placed on the base plate 334, and the mounting member 31 is fixed by the two support members 334*a*. A plurality of plate-shaped members 32 are turnably supported on the support members 334*a*, which remain underneath the mounting member 31 while the foldable article has yet to be mounted. Furthermore, the mounting member 31 and the plurality of plate-shaped members 32 rotate according to the rotation of the base plate 334. The mounting member 31 remains placed in the state shown in FIG. 1; i.e., in a state in which one surface faces upward in FIG. 1 while a foldable article has yet to be mounted.

Figure 8:
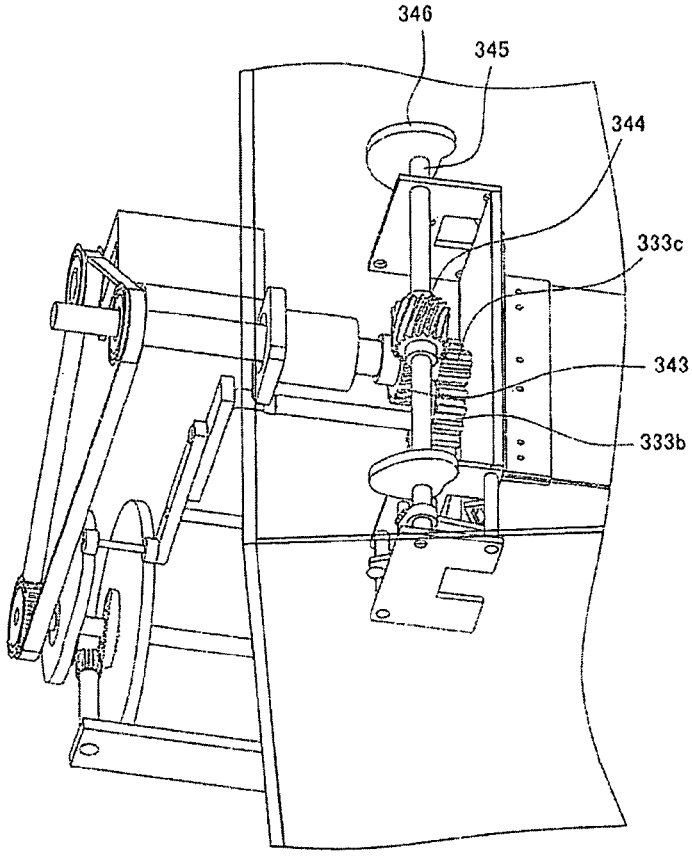
FIG. 8 is a view showing the vicinity of the mounting member.

The turning mechanism 34 is a mechanism for turning the plurality of plate-shaped members 32 toward the mounting member 31, and is placed at the second end 31*b* of the mounting member 31, as shown in FIGS. 5, 7, and 8. The turning mechanism 34 comprises the first drive motor 331, the first pulley 332*a*, the third pulley 341, the transmission belt 332*c*, a turning mechanism rotating shaft 342, a first turning gear 343, a second turning gear 344, a second turning shaft 345, a first turning cam 346, a first turning plate member 347, a second turning plate member 348, a first turning shaft 349, a second turning cam 350, a third turning plate member 351, a fourth turning plate member 352, a second turning shaft 353, a third turning cam 354, a fifth turning plate member 355, a sixth turning plate member 356, and a third turning shaft 357. The third pulley 341 is a discoid member of the same shape as the first pulley 332*a* and the second pulley 332*b*, and is placed above the first pulley 332*a*. The turning mechanism rotating shaft 342 is a shaft member attached to the third pulley 341, and is disposed so as to pass through the frame 2. A bearing and supporting cylinder member is placed on the turning mechanism rotating shaft 342 in order to enable the shaft to rotate relative to the frame 2. The first turning gear 343 is a member placed at the end of the turning mechanism rotating shaft 342, and is provided in proximity to the second rotating gear 333*c*. The first turning gear 343 is a helical gear in which the screw thread is formed in a helical shape on the second turning shaft 345. The second turning gear 344 is a gear meshed with the first turning gear 343, and is placed above the first turning gear 343. The second turning gear 344 is a helical gear, which is formed a helical screw thread that meshes with that of the first turning gear 343. The second turning shaft 345 is a shaft-shaped member that passes through the second turning gear 344, and is caused to rotate according to the rotation of the second turning gear 344. The first turning cam 346 is attached to one end of the second turning shaft 345, and the first turning plate member 347 is attached to the external periphery of the first turning cam 346. The first turning cam 346 rotates counterclockwise in FIG. 1. The first turning plate member 347 is a plate-shaped member extending in one direction, wherein the first turning cam 346 is fixed to one end and the second turning plate member 348 is disposed at the other end. The first turning plate member 347 is turnably attached in the center to the base plate 334 (see FIG. 1). The second turning plate member 348 is a plate-shaped member extending in one direction, and a hole extending along the direction in which the second turning plate member 348 extends is provided in the center thereof. The first turning shaft 349 is attached to one end of the second turning plate member 348. Therefore, when the first turning cam 346 rotates, the first turning plate member 347 and the second turning plate member 348 are caused to rotate according to the rotation of the first turning cam 346, and the first turning shaft 349 is caused to rotate according to the rotation of the second turning plate member 348. The first plate-shaped member 321 turns toward the mounting member 31 when the first turning shaft 349 rotates. The first turning shaft 349 is a portion attached to the first connecting part 321*a* of the first plate-shaped member 321. The second turning cam 350 is a member provided in proximity to the other end of the second turning shaft 345, and the third turning plate member 351 is attached to the external periphery of the second turning cam 350. The third turning plate member 351 is a plate-shaped member wherein one end is attached to the second turning cam 350, and the other end is attached to the fourth turning plate member 352. A hole extending in one direction is formed in the center of the fourth turning plate member 352, and a shaft provided at one end of the third turning plate member 351 is turnably placed in the hole. The second turning shaft 353 is placed at one end of the fourth turning plate member 352. The second turning shaft 353 is a cylindrical member, and the second plate-shaped member 322 is placed at the end on the side opposite where the fourth turning plate member 352 is placed. When the second turning shaft 345 rotates, the second turning shaft 353 rotates via the third turning plate member 351 and the fourth turning plate member 352, and the second plate-shaped member 322 turns toward the mounting member 31. The third turning cam 354 is placed farther toward the other end of the second turning shaft 345 than the second turning cam 350, and the fifth turning plate member 355 is attached to the external periphery of the third turning cam 354. The fifth turning plate member 355 is a plate-shaped member wherein one end is fixed to the external periphery of the third turning cam 354, and the sixth turning plate member 356 is attached to the other end. The sixth turning plate member 356 has a hole extending in one direction formed in the center, and the third turning shaft 357 is placed at the other end. A shaft provided at the end of the fifth turning plate member 355 is placed in the hole of the sixth turning plate member 356. When the second turning shaft 345 rotates, the third turning shaft 357 is caused to rotate according to this rotation via the fifth turning plate member 355 and the sixth turning plate member 356. The third plate-shaped member 323 turns toward the mounting member 31 when the third turning shaft is rotated. The third turning shaft 357 is attached at one end to the sixth turning plate member 356, and the third plate-shaped member 323 is attached in the vicinity of the other end. The third turning shaft 357 is disposed so as to pass through the second turning shaft 353.

4. Conveying Apparatus

Figure 9:
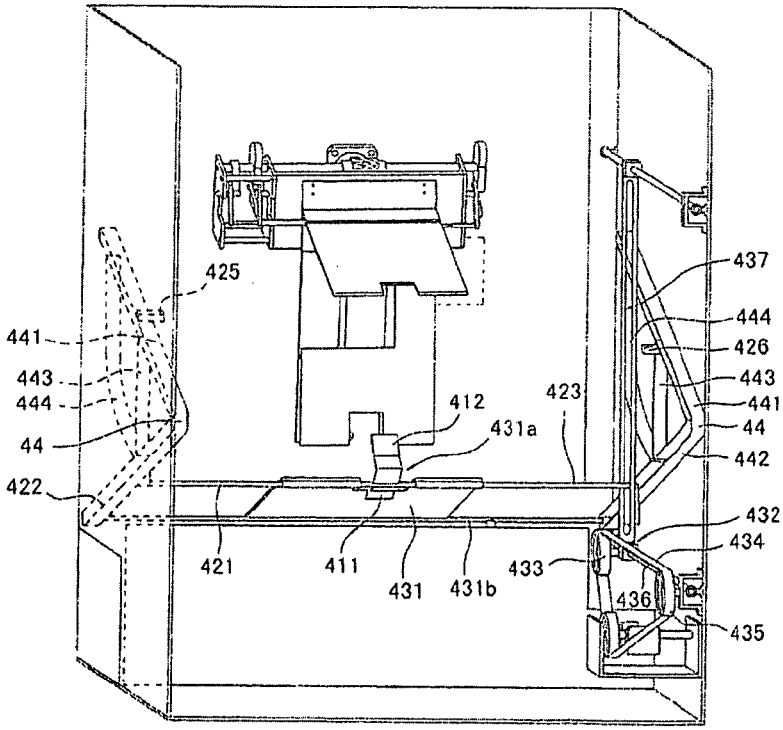
FIG. 9 is a view of the folding apparatus as seen from the left side of FIG. 1.
Figure 10:
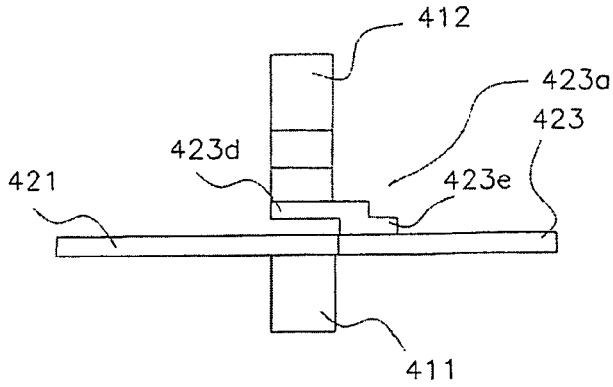
FIG. 10 is a view showing the first holding member and the second holding member.

The conveyor 4 is an apparatus for conveying folded articles to a predetermined location, the folded articles being foldable articles that have been folded, and is placed underneath the folding part 3, as shown in FIGS. 1, 9, and 10. The conveyor 4 comprises a holding mechanism 41 and a conveyed article movement mechanism 43.

The holding mechanism 41 is a mechanism for holding folded shirts, and the holding mechanism 41 comprises a first holding member 411 provided at the end of a conveyed article mounting member 431 described below, a second holding member 412 provided at one end of the conveyed article mounting member 431 described below, and a holding member movement mechanism 42. The first holding member 411 is a plate-shaped member that can pass through the cutout 311 in the mounting member 31, and the first holding member 411 is placed below the mounting member 31 while the conveyed article mounting member 431 described below is at its lowest position. The second holding member 412 is a plate-shaped member placed above the mounting member 31 so as to face the first holding member 411, and is capable of passing through the cutout 311 in the mounting member 31. The second holding member 412 is a member bent into the shape of a V. The holding member movement mechanism 42 is a mechanism for moving the first holding member 411 and the second holding member 412 holding folded shirts, and the mechanism comprises a first holding rotating shaft 421, a first holding lever 422, a second holding rotating shaft 423, a second holding lever 424, first holding lever protuberances 425, and second holding lever protuberances 426. The first holding rotating shaft 421 is a member wherein the first holding member 411 is provided at one end, and is a shaft member extending in a direction orthogonal to the direction in which the conveyed article mounting member 431 (described below) extends. The first holding lever 422 is a member placed at the other end of the first holding rotating shaft 421, and is provided in a direction orthogonal to the direction in which the first holding rotating shaft 421 extends. The first holding rotating shaft 421 can be rotated and the first holding member 411 can be rotated by rotating the first holding lever 422. The second holding rotating shaft 423 is a member extending in the direction in which the first holding rotating shaft 421 extends, and is placed so as to be adjacent to the lateral end where the first holding member 411 is placed. The second holding rotating shaft 423 is capable of rotating relative to the first holding rotating shaft 421, and the second holding member 412 is provided at the lateral end where the first holding rotating shaft 421 is laced. Specifically, the second holding member 412 is attached to the second holding rotating shaft 423 via an intermediate connecting member 423*a* comprising a rectangular support part 423*d* on the second holding rotating shaft 423, and a connecting part 423*e* for positioning the second holding member 412 at the same axial position on the second holding rotating shaft 423 as the axial position (in the axial direction of the first holding rotating shaft 421 and the second holding rotating shaft 423) of the first holding member 411, as shown in FIG. 10. The second holding lever 424 is a portion provided to the second holding rotating shaft 423 at the end opposite the second holding member 412, and is provided in a direction orthogonal to the direction in which the second holding rotating shaft 423 extends. The second holding rotating shaft 423 can be rotated by rotating the second holding lever 424, and as a result, the second holding member 412 can be turned toward the foldable article. The first holding lever protuberance 425 is a member provided in proximity to a holding rotating shaft guide member 44 described below, and the first holding lever protuberance 425 rotates the first holding lever 422 according to the movement of the first holding rotating shaft 421. Specifically, the first holding member 411 is turned toward the folded article. The second holding lever protuberance 426 is a member provided in proximity to the holding rotating shaft guide member 44 described below, and the second holding lever protuberance 426 rotates the second holding lever 424 according to the movement of the second holding rotating shaft 423. Specifically, the second holding member 412 is turned toward the folded shirt. A holding contact lever 49 (see FIG. 16) is placed at the end of the first holding rotating shaft 421 on the side opposite where the first holding member 411 is placed, and at the end of the second holding rotating shaft 423 on the side opposite where the first holding member 411 is placed.

The conveyed article movement mechanism 43 is a mechanism for moving folded shirts to a predetermined position, the mechanism comprising the conveyed article mounting member 431, a second drive motor 432, a first movement pulley 433, a second movement pulley 434, a third movement pulley 438, a movement transmission belt 435, a first guide rod 436, a second guide rod 439, a first movement guide member 437*a*, a second movement guide member 437*b*, and the holding rotating shaft guide member 44.

The conveyed article mounting member 431 is a plate-shaped member having substantially the same shape as the mounting member 31, wherein the first and second holding rotating shafts 421, 423 are placed at one end thereof. A cutout 431*a* is provided at the lateral end where the first and second holding rotating shafts 421, 423 are placed, allowing the first holding member 411 and the second holding member 412 to pass through. Furthermore, a shaft member 431*b* parallel to the first and second holding rotating shafts 421, 423 is placed at the end of the side opposite where the first and second holding rotating shafts 421, 423 are placed.

The second drive motor 432 is a member for generating power for moving the conveyed article mounting member 431, and is placed at the bottom of the apparatus.

The first movement pulley 433 is a discoid member attached to the second drive motor 432.

The second movement pulley 434 is a discoid member provided above the first movement pulley 433 at the lateral end where the rotation mechanism 33 is provided, and is attached to the frame 2.

The third movement pulley 438 is provided to a position at the same height as the second movement pulley 434, and is placed at the lateral end opposite the lateral end where the second movement pulley 434 is provided.

The movement transmission belt 435 is a member installed between the first movement pulley 433 and the second movement pulley 434, and the movement transmission belt 435 circulates when the first movement pulley 433 is caused to rotate.

The first guide rod 436 is a rod-shaped member attached at both ends to the frame 2, and is provided so as to be substantially parallel to the bottom surface of the frame 2.

The second guide rod 439 is a member fixed at both ends to the frame 2, and is provided above the holding rotating shaft guide member 44. The second guide rod 439 is also a member disposed so as to be parallel to the first guide rod 436.

The first movement guide member 437*a* is a member extending in a direction substantially orthogonal to, i.e., substantially perpendicular to the first and second guide rods 436, 439, and is placed between the first guide rod 436 and the second guide rod 439. The first movement guide member 437*a* is attached to the movement transmission belt 435 and the first and second guide rods 436, 439 so as to be capable of sliding relative to the first and second guide rods 436, 439. Therefore, when the second drive motor 432 rotates and the movement transmission belt 435 circulates, the first movement guide member 437*a* slides along the first and second guide rods 436, 439. A first slit 437*c* extending in a substantially perpendicular direction is formed in the first movement guide member 437*a*, and through this first slit 437*c* the first holding rotating shaft 421 is inserted, i.e., is placed between the lateral end of the second holding member 412 and the second holding lever 424.

The second movement guide member 437*b* is a member extending in a direction substantially orthogonal to, i.e., substantially perpendicular to the first and second guide rods 436, 439, and is placed between the first guide rod 436 and the second guide rod 439. The second movement guide member 437*b* is a member disposed so as to be substantially parallel to the first movement guide member 437*a*, and is placed to the right of the first movement guide member 437*a* in FIG. 1. Furthermore, the second movement guide member 437*b* is attached to the movement transmission belt 435 and the guide rod 436 so as to be capable of sliding relative to the first and second guide rods 436, 439. Therefore, the second movement guide member 437*b* slides along the first and second guide rods 436, 439 when the second drive motor 432 is rotated and the movement transmission belt 435 is circulated. A second slit 437*d* extending in a substantially perpendicular direction is formed in the second movement guide member 437*b*, and the shaft member 431*b* is inserted through the second slit 437*d*. Since the first and second movement guide members 437*a*, 437*b* are placed between the first guide rod 436 and the second guide rod 439, the first and second movement guide members 437*a*, 437*b* are supported in a stable manner.

The holding rotating shaft guide member 44 is a member for guiding the movement of the conveyed article mounting member 431, and is composed of a pair of members placed at the axial outer sides of the first and second holding rotating shafts 421, 423. The holding rotating shaft guide member 44 guides the conveyed article mounting member 431 so as to be capable of moving between a mounting position where folded articles are mounted on the conveyed article mounting member 431, and a stacking position where folded articles are stacked on a stacking plate 51 of the stacking part 5. Each holding rotating shaft guide member 44 has a first guide part 441, a second guide part 442, a third guide part 443, a fourth guide part 444, a first turning guide member 445, a second turning guide member 446, a third turning guide member 447, and a fourth turning guide member 448. Grooves having a width that allows the first and second holding rotating shafts 421, 423 and the shaft member 431*b* to move are formed in each first guide part 441, second guide part 442, third guide part 443, and fourth guide part 444.

The first guide parts 441 are placed at an incline so that the ends on the side where the rotation mechanism 33 and turning mechanism 34 are placed are positioned higher than the ends on the other side, and the first guide parts 441 have a predetermined length. The first holding lever protuberance 425 is placed in the vicinity of the portion where one first guide part 441 and one third guide part 443 connect, and the second holding lever protuberance 426 (see FIG. 9) is placed in the vicinity of the portion where the other first guide part 441 and the other third guide part 443 connect.

The second guide parts 442 are placed at an incline so that the ends on the side where the rotation mechanism 33 and turning mechanism 34 are placed are positioned lower than the ends on the other side, and the second guide parts 442 have a predetermined length. The second guide parts 442 are connected with the first guide parts 441 at one end. In the initial state (the state when a conveyed article (a shirt or the like) has yet to be placed on the conveyed article mounting member), the conveyed article mounting member 431 is placed at the lateral ends of the second guide parts 442 where the rotation mechanism 33 and turning mechanism 34 are placed.

The third guide parts 443 are portions for connecting the first guide parts 441 and the second guide parts 442, and are arcuate portions placed at locations separated at fixed distances from the portions where the first guide parts 441 and the second guide parts 442 connect. These fixed distances are the same distance as the distance between the first and second holding rotating shafts 421, 423 and the shaft member 431*b*. Therefore, the shaft member 431*b* is capable of moving the third guide parts 443 while the first and second holding rotating shafts 421, 423 remain positioned at the portions where the first guide parts 441 and the second guide parts 442 connect.

The fourth guide parts 444 are placed so as to connect the first guide parts 441 and the second guide parts 442, and are placed nearer to the mounting position and the stacking position than the third guide parts 443. The fourth guide parts 444 are portions formed into substantially arcuate shapes, and are connected from the substantial centers of the second guide parts 442 to the vicinities of the lateral ends of the first guide parts 441 where the rotation mechanism 33 is placed.

The first turning guide members 445 are plate-shaped members, and are placed at the portions where the second guide parts 442 are connected to the first guide parts 441, i.e., at the ends of the first guide parts 441 and second guide parts 442 opposite the side where the rotation mechanism 33 is placed (the right in FIG. 1). The first turning guide members 445 have first turning guide rotating shafts 445*a*, first turning guide upper members 445*b*, first turning guide middle members 445*c*, first turning guide lower members 445*d*, first turning guide upper stoppers 445*e*, and first turning guide lower stoppers 445*f*. The first turning guide rotating shafts 445*a* are columnar members attached to the frame 2, and are placed at the portions where the first guide parts 441 are connected to the second guide parts 442. The first turning guide upper members 445*b* are members placed at higher positions than the first turning guide middle members 445*c* and the first turning guide lower members 445*d*, and are turnably attached at one end to the first turning guide rotating shafts 445*a*. The first turning guide middle members 445*c* are members placed between the first turning guide upper members 445*b* and the first turning guide lower members 445*d*, and are turnably attached at one end to the first turning guide rotating shafts 445*a*. The first turning guide lower members 445*d* are turnably attached at one end to the first turning guide rotating shafts 445*a*. The first turning guide upper stoppers 445*e* are members provided above the first turning guide rotating shafts 445*a*, and are columnar members. The first turning guide lower stoppers 445*f* are members placed below the first turning guide rotating shafts 445*a*, and are members for stopping the first turning guide lower member 445*d* from turning by coming into contact with the first turning guide lower members 445*d*.

Figure 11:
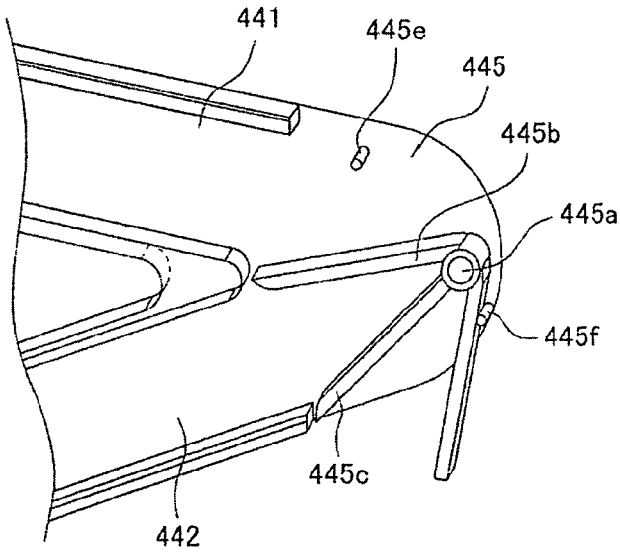
FIG. 11 is a view showing a first rotating guide member in contact with a first rotating guide upper stopper.
Figure 12:
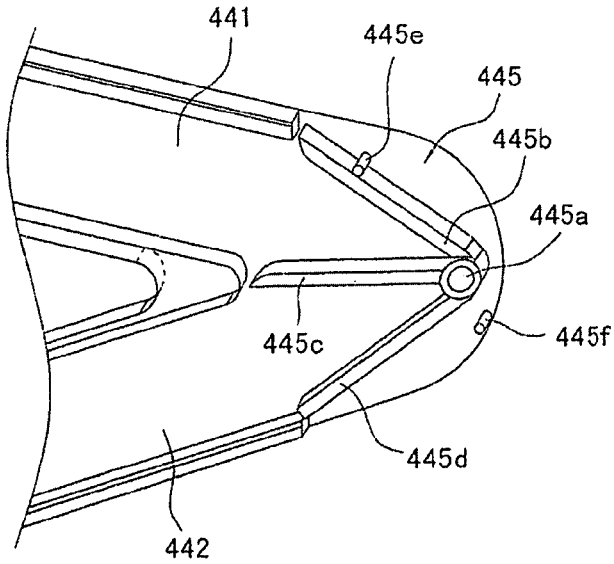
FIG. 12 is a view showing a first rotating guide member in contact with a first rotating guide lower stopper.

When the first turning guide lower stoppers 445*f* and the first turning guide lower members 445*d* are in contact, the lateral ends of the first turning guide upper members 445*b* where the first turning guide rotating shafts 445*a* are not placed and the lateral ends of the first turning guide middle members 445*c* where the first turning guide rotating shafts 445*a* are not placed are positioned at the ends of the second guide parts 442 as shown in FIG. 11. Hook-and-loop fasteners are placed on the portions of the first turning guide upper stoppers 445*e* that contact the first turning guide upper members 445*b*, and on the surfaces of the first turning guide upper members 445*b* that face the first turning guide upper stoppers 445*e*, and the first turning guide upper members 445*b* are kept in a state of contact with the first turning guide upper stoppers 445*e* as shown in FIG. 12 by contact between the hook-and-loop fasteners. While the first turning guide upper members 445*b* remain in contact with the first turning guide upper stoppers 445*e*, the ends of the first turning guide middle members 445*c* on the sides opposite the first turning guide rotating shafts 445*a* and the ends of the first turning guide lower members 445*d* on the sides opposite where the first turning guide rotating shafts 445*a* are placed are positioned at the ends of the second guide parts 442 on the sides opposite the ends where the rotation mechanism 33 is placed.

Figure 13:
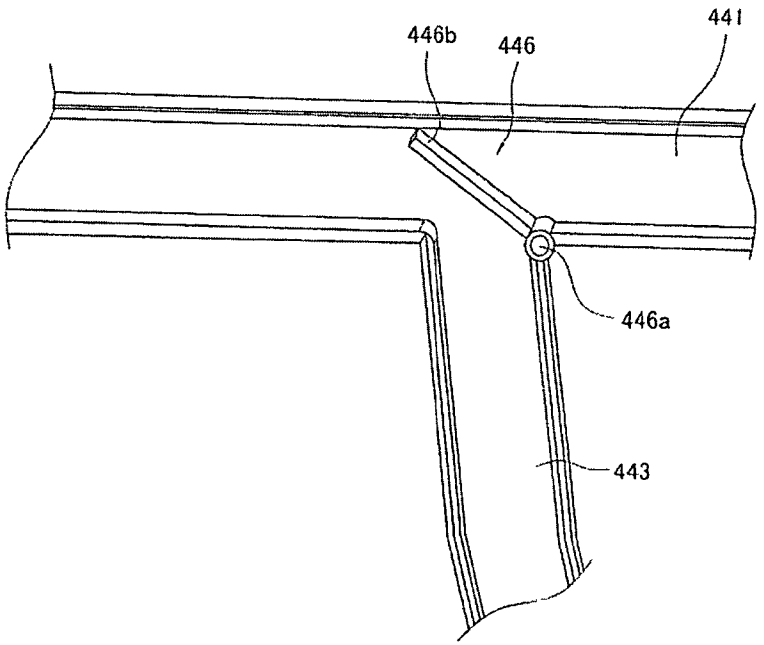
FIG. 13 is a view showing a second rotating guide member.

The second turning guide members 446 are members provided to the portions where the third guide parts 443 are connected to the first guide parts 441 as shown in FIG. 13, and are also members for preventing the first and second holding rotating shafts 421, 423 from moving from the first guide parts 441 to the third guide parts 443 when the first and second holding rotating shafts 421, 423 are positioned above the second guide parts 442, and for moving the shaft member 431*b* from the first guide parts 441 to the third guide parts 443 when the shaft member 431*b* moves from the lateral ends of the first guide parts 441 where the rotation mechanism 33 is placed to the lateral ends opposite the lateral ends where the rotation mechanism 33 is placed. The second turning guide members 446 have second turning guide rotating shafts 446*a* and second turning guide bifurcating members 446*b*. The second turning guide rotating shafts 446*a* are columnar members. The second turning guide bifurcating members 446*b* are plate-shaped members and are attached at one end to the second turning guide rotating shafts 446*a*. The second turning guide bifurcating members 446*b* are members disposed at an incline of a predetermined angle in relation to the first guide parts 441 as shown in FIG. 13, blocking off the side where the rotation mechanism 33 is placed from the opposite side of where the rotation mechanism 33 is placed. The second turning guide bifurcating members 446*b* are capable of turning around the second turning guide rotating shafts 446*a*, but may also be fixed in place so as to be incapable of turning.

Figure 14:
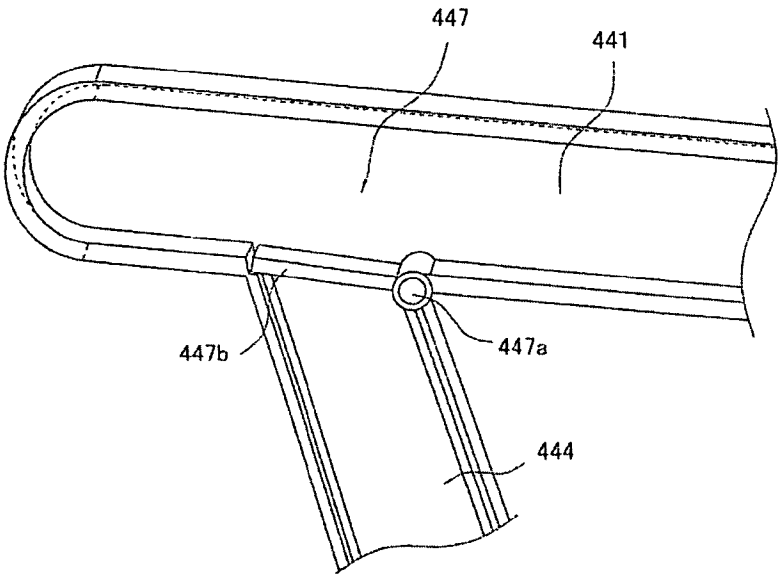
FIG. 14 is a view showing a third rotating guide member.

The third turning guide members 447 are members provided to the portions where the fourth guide parts 444 are connected to the first guide parts 441 as shown in FIG. 14, and are also members for allowing the shaft member 431*b* to move from the fourth guide parts 444 toward the first guide parts 441, and for blocking the shaft member 431*b* from moving from the first guide parts 441 toward the fourth guide parts 444. The third turning guide members 447 have third turning guide rotating shafts 447*a* and third turning guide bifurcating members 447*b*. The third turning guide rotating shafts 447*a* are columnar members. The third turning guide bifurcating members 447*b* are attached at one end to the third turning guide rotating shafts 447*a*, and are plate-shaped members having a greater width than the fourth guide parts 444. The third turning guide bifurcating members 447*b* are members placed so as to close off the third guide parts 443, and these members turn when the first and second holding rotating shafts 421, 423 move from the third guide parts 443 toward the first guide parts 441.

Figure 15:
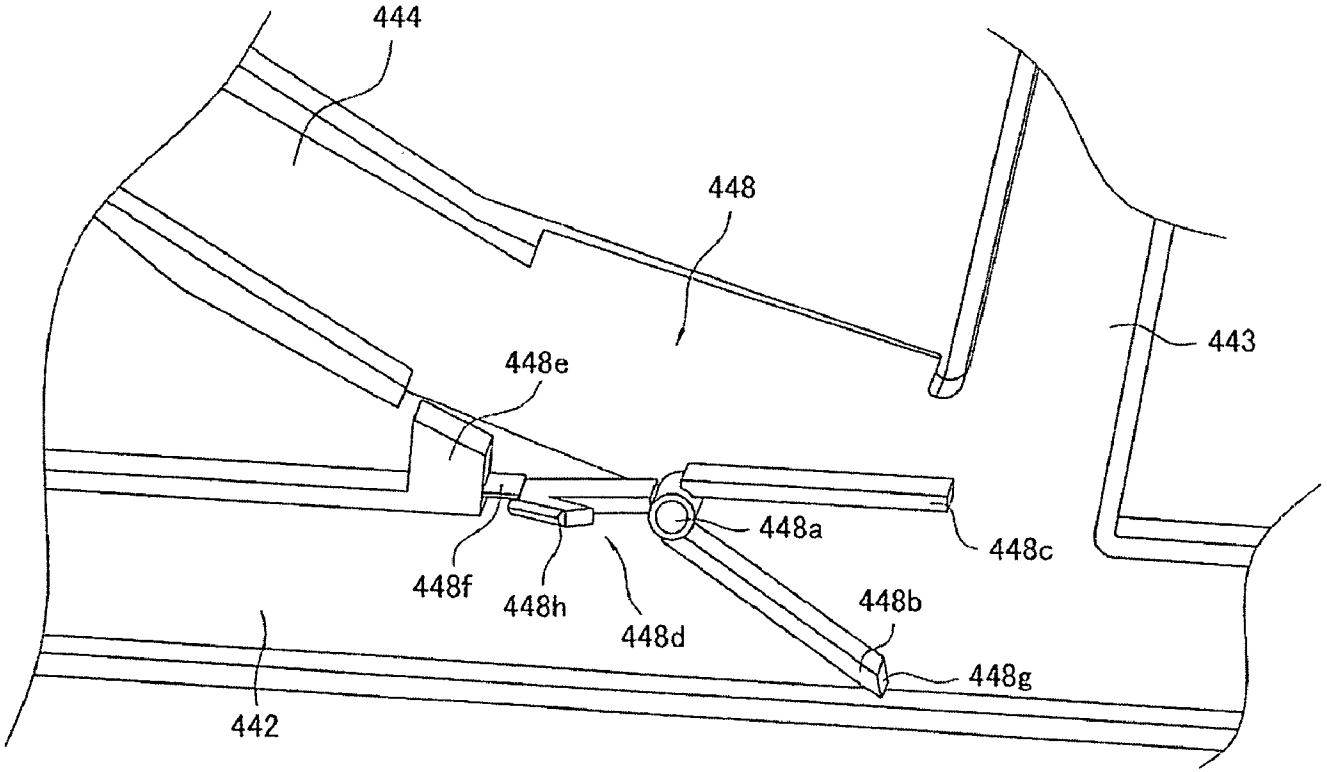
FIG. 15 is a view showing a fourth rotating guide member.
Figure 16:
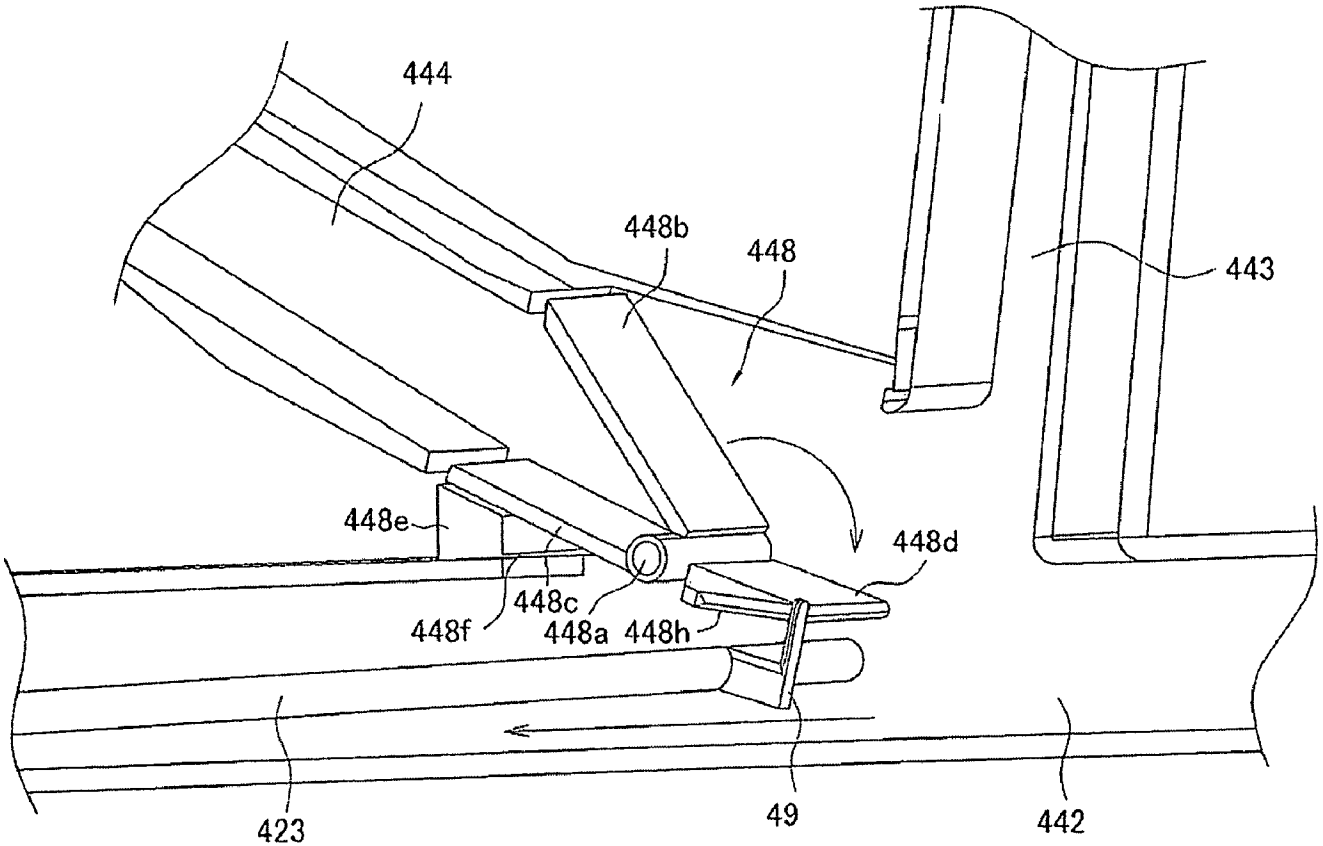
FIG. 16 is a view showing a fourth rotating guide member and the first or second holding rotating shaft.

The fourth turning guide members 448 are provided to the portions where the fourth guide parts 444 are connected to the second guide parts 442 as shown in FIGS. 15 and 16, and are members for bifurcating the direction in which the first and second holding rotating shafts 421, 423 and the shaft member 431*b* move. The fourth turning guide members 448 have fourth turning guide rotating shafts 448*a*, first bifurcating guide members 448*b*, second bifurcating guide members 448*c*, and third bifurcating guide members 448*d*. The portions where the fourth guide parts 444 are connected to the first guide parts 441 are provided with first stoppers 448*e* for stopping the rotation of the second bifurcating guide members 448*c*, and second stoppers 448*f* for stopping the rotation of the third bifurcating guide members 448*d*, as shown in FIG. 15. The fourth turning guide rotating shafts 448*a* are columnar members. The first bifurcating guide members 448*b* are members placed so as to block off the sides of the first guide parts 441 where the rotation mechanism 33 are placed and the sides opposite the sides where the rotation mechanism 33 are placed when the conveyed article mounting member 431 is positioned at the stacking position, and the first bifurcating guide members 448*b* are also plate-shaped members. The first bifurcating guide members 448*b* are rotatably attached at one end to the fourth turning guide rotating shafts 448*a*. The distal ends at the other ends of the first bifurcating guide members 448*b* are provided with inclined surfaces 448*g* so that while the conveyed article mounting member 431 is positioned at the stacking position, the bottom ends are positioned to the left in FIG. 15 (the right in FIG. 1) of the top ends. The second bifurcating guide members 448*c* are members for guiding the first and second holding rotating shafts 421, 423 toward the fourth guide parts 444 when the first and second holding rotating shafts 421, 423 move from the first guide parts 441 toward the fourth guide parts 444, and the second bifurcating guide members 448*c* are also plate-shaped members. The second bifurcating guide members 448*c* rotate around the fourth turning guide rotating shafts 448*a*, and constitute part of the second guide parts 442 while in contact with the first stoppers 448*e*. The third bifurcating guide members 448*d* are in contact with the second stoppers 448*f* while the conveyed article mounting member 431 is positioned in the stacking position, and the third bifurcating guide members 448*d* are plate-shaped members having a substantial V shape and are attached at one end to the fourth turning guide rotating shafts 448*a*. In the vicinities of the distal ends near the second stoppers 448*f*, the third bifurcating guide members 448*d* have contact portions 448*h* extending at an incline towards the front of the paper surface in FIG. 15. The shaft member 431*b* moves in the direction in which the rotation mechanism 33 is provided and thereby rotates around the fourth turning guide rotating shafts 448*a*, while the contact portions 448*h* of the third bifurcating guide members 448*d* are in contact with the holding contact lever 49 (see FIG. 16) provided in proximity to the guide parts of the first and second holding rotating shafts 421, 423. The first holding lever protuberances 425 and the second holding lever protuberances 426 are placed on the first guide parts 441 and the fourth guide parts 444, respectively. In cases in which part of a foldable article hangs down at one end of the mounting member 31, part of the foldable article can be inserted in between the conveyed article mounting member 431 and the mounting member 31 and folded when the conveyed article mounting member 431 moves from the stacking position to the mounting position.

5. Stacking Part 5

The stacking part 5 is an apparatus on which folded articles such as shirts are placed and folded articles are stacked, and the stacking part 5 is placed at the bottom of the folding apparatus. The stacking part 5 comprises the stacking plate 51, stacking guide rods 52, a dividing plate 53, and springs 54.

The stacking plate 51 is a plate-shaped member provided so as to be positioned below the conveyed article mounting member 431 when the conveyed article mounting member 431 is positioned at the stacking position. Furthermore, the stacking plate 51 is provided with two holes through which the stacking guide rods 52 can be inserted.

The stacking guide rods 52 are members extending substantially perpendicular from the bottom surface of the frame 2 to a predetermined height, and are placed so as to pass through the holes in the stacking plate 51.

The dividing plate 53 is a member for supporting the folded articles stacked on the stacking plate 51 so that the folded articles do not fall off, and the dividing plate 53 is placed at the end of the stacking plate 51.

The springs 54 are members that compress according to the weight of the folded articles, and are placed so that the stacking guide rods 52 pass through. The springs 54 are placed between the bottom surface of the frame 2 and the stacking plate 51. Therefore, the springs 54 are compressed by the weight of the folded articles when the folded articles are mounted on the stacking plate 51.

As the amount of folded articles mounted on the stacking plate 51 increases, the height position of the stacking plate 51 lowers according to the weight of the folded articles, increasing the space in which new folded articles can be accommodated and stacked.

6. Operation

The operation of folding will now be described.

Figure 18:
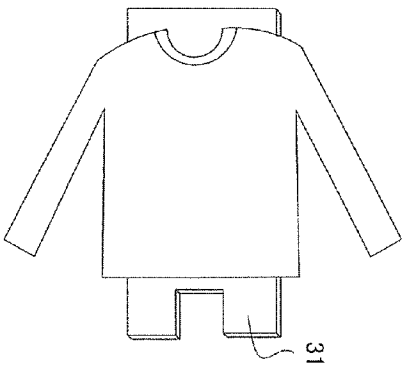
FIG. 18 is a view showing a state in which a foldable article such as a shirt is mounted-on the mounting member.
Figure 19:
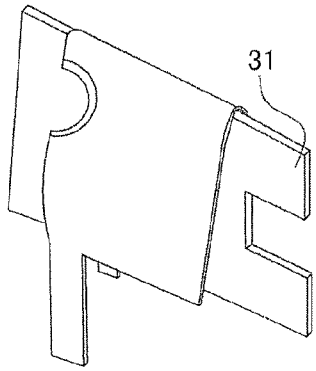
FIG. 19 is a view showing a state in which the mounting member is rotated 90° from the state in FIG. 18.
Figure 20:
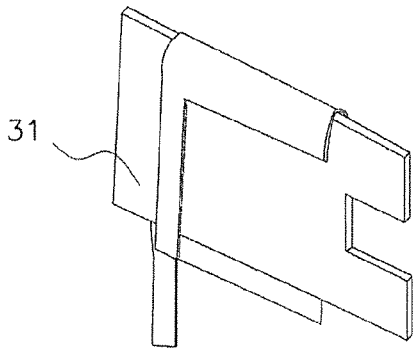
FIG. 20 is a view of the mounting member in the state in FIG. 19 as seen from a different position (from behind)
Figure 21:
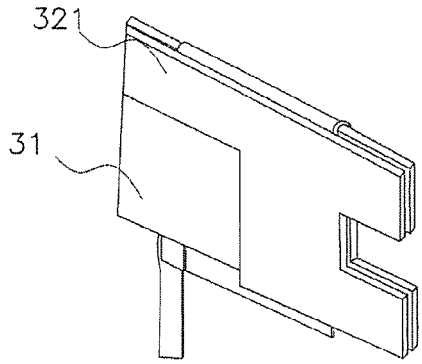
FIG. 21 is a view of part of a shirt held by the mounting member and the first plate-shaped member.

The initial state of the mounting member 31 is the state shown in FIG. 1, wherein the mounting member 31 is substantially parallel to the first guide parts 441 of the apparatus, and the plurality of plate-shaped members 32 are opened at substantially orthogonal angles to the mounting member 31. In this state, a foldable article, e.g., a shirt is mounted on the surface on one side of the mounting member 31 so that part of the shirt hangs down from the mounting member 31, as shown in FIG. 18 (first step). The second pulley 332*b* is rotated via the first pulley 332*a* by the power from the first drive motor 331, and the first transmission cam 332*d* and second transmission cam 332*h* are rotated according to the rotation of the second pulley 332*b*. At this time, the dumbbell-shaped member 332*i* is rotated counterclockwise in FIG. 5 by the second transmission cam 332*h*. The mounting member 31 changes from the initial state to a state inclined at 90° shown in FIG. 19, by the rotation of the dumbbell-shaped member 332*i*. With this change, part of the shirt (one sleeve or the like) mounted on the mounting member 31 is hung by gravity so as to be positioned in proximity to the surface of the mounting member 31 opposite the side on which the shirt is mounted (second step) (see FIG. 20). At this time, the third pulley 341 also rotates according to the rotation of the first pulley 332*a*, and the second turning shaft 345 is caused to rotate according to the rotation of the third pulley 341. The first turning cam 346 rotates according to the rotation of the second turning shaft 345, and the first plate-shaped member 321 turns toward the mounting member 31 according to the rotation of the first turning cam 346 (third step). At this time, part of the shirt (one sleeve or the like) is held between the mounting member 31 and the first plate-shaped member 321, whereby the shirt is folded (see FIG. 21).

Figure 22:
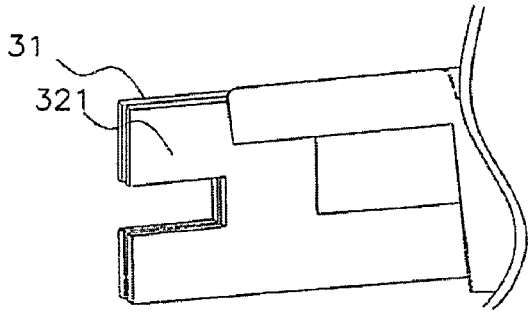
FIG. 22 is a view of state in which the mounting member or the like is rotated 180° from the state in FIG. 21 and part of the shirt hangs down.
Figure 23:
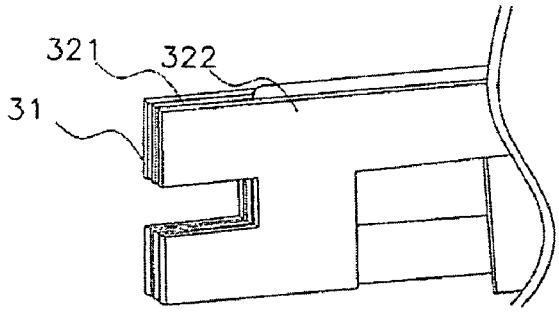
FIG. 23 is a view of a state in which the second plate-shaped member is moved toward the mounting member in the state shown in FIG. 22.

From this state, the second pulley 332*b* rotates further, the first transmission farthest portion 332*k* of the first transmission cam 332*d* begins to come in contact with the dumbbell-shaped member 332*i*, and the dumbbell-shaped member 332*i* is caused to rotate clockwise in FIG. 5. With the rotation of the dumbbell-shaped member 332*i*, the mounting member 31 and the first plate-shaped member 321 are caused to rotate 180° clockwise in FIG. 5. At this time, part of the shirt (the other sleeve or the like) is positioned in proximity to the surface of the first plate-shaped member 321 on the side opposite the surface facing the mounting member 31, as shown in FIG. 22 (fourth step). At this time, the second pulley 332*b* is also caused to rotate further. The second turning shaft 353 is caused to rotate by the rotation of the second pulley 332*b*, and the second turning cam 350 rotates. The second plate-shaped member 322 turns toward the first plate-shaped member 321 by the rotation of the second turning cam 350. Part of the shirt (the other sleeve or the like) is then held and folded by the first plate-shaped member 321 and the second plate-shaped member 322 by the turning operation of the second plate-shaped member 322, as shown in FIG. 23 (fifth step).

Figure 24:
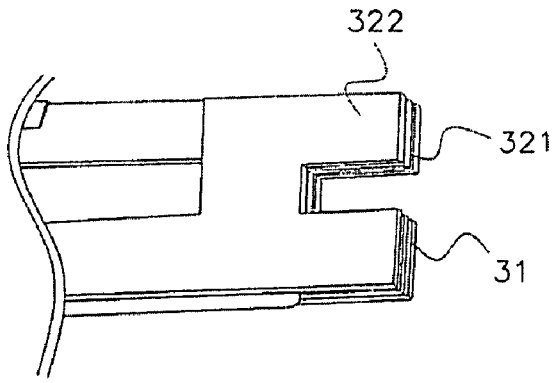
FIG. 24 is a view of a state in which the mounting member or the like is rotated 180° from the state shown in FIG. 23.
Figure 25:
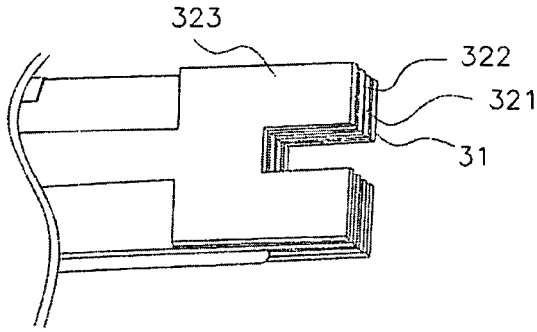
FIG. 25 is a view of a state in which the third plate-shaped member is moved toward the mounting member from the state shown in FIG. 24.

From this state, the first pulley 332*a* rotates further. The second pulley 332*b* rotates according to this rotation, and the first transmission cam 332*d* and second transmission cam 332*h* rotate as well. At this time, the second transmission cam 332*h* comes in contact with the dumbbell-shaped member 332*i*, and the dumbbell-shaped member 332*i* is caused to rotate counterclockwise in FIG. 5 in accordance with the rotation of the second transmission cam 332*h*. The mounting member 31 and the first and second plate-shaped members 321, 322 rotate 180° counterclockwise in FIG. 9, according to the rotation of the dumbbell-shaped member 332*i*. At this time, part of the shirt (the end of the other sleeve or the like) is positioned in proximity to the surface of the second plate-shaped member 322 on the side opposite the surface facing the first plate-shaped member 321, as shown in FIG. 24 (sixth step). At the same time, the third pulley 341 also is caused to rotate further, and the second turning shaft 345 rotates by the rotation of the third pulley 341. The third turning cam 354 rotates by the rotation of the second turning shaft 345, and the third plate-shaped member 323 turns toward the second plate-shaped member 322 (seventh step). Part of the shirt (the end of the other sleeve or the like) is held and folded by the second plate-shaped member 322 and the third plate-shaped member 323, as shown in FIG. 25.

From this state, the second pulley 332*b* rotates further, and the mounting member 31 and the plurality of plate-shaped members 32 are caused to rotate 90° clockwise in FIG. 9.

Next, the conveying operation will be described.

Figure 17:
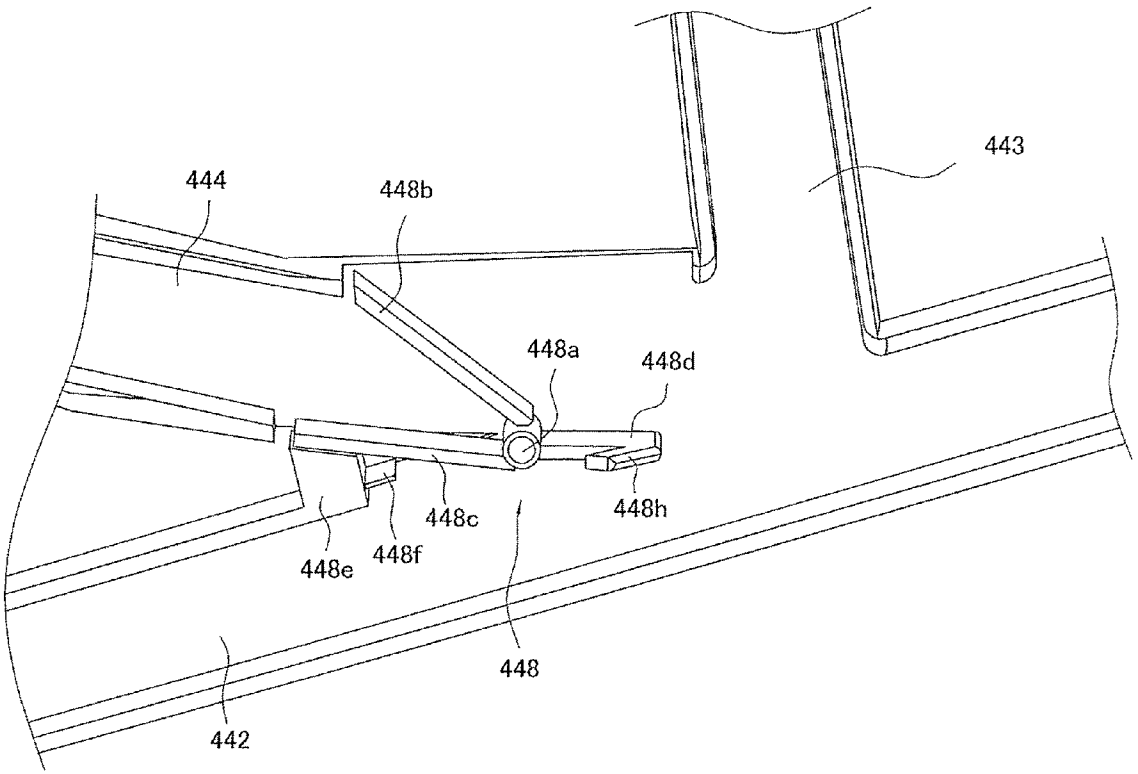
FIG. 17 is a view showing a state in which a fourth rotating guide member is in contact with a first and second stopper.

In the initial state, the conveyor 4 is in the state shown in FIG. 1, i.e., the state in which the height position of the conveyed article mounting member 431 is lowest. After the foldable article is folded by the mounting member 31 and the plurality of plate-shaped members 32, the first movement pulley 433 is caused to rotate by the power from the second drive motor 432. The movement transmission belt 435 is circulated according to the rotation of the first movement pulley 433. The first movement guide member 437*a* and the second movement guide member 437*b* are moved to the left in FIG. 1 by the circulation of the movement transmission belt 435. When the conveyed article mounting member 431 is positioned as far to the left as possible in FIG. 1, the first holding rotating shaft 421 and second holding rotating shaft 423 move between the first turning guide upper members 445*b* and first turning guide middle member 445*c* and arrive in proximity to the first turning guide rotating shafts 445*a*. The conveyed article mounting member 431 then moves to the left in FIG. 1. At this time, the first turning guide members 445 are rotated, moving from the state in FIG. 11 to the state in FIG. 12. At this time, the shaft member 431*b* moves toward the fourth guide parts 444, being guided by the first bifurcating guide members 448*b* of the fourth turning guide members 448. Specifically, the shaft member 431*b* moves to the top of FIG. 15, and the second bifurcating guide members 448*c* are moved to the left of FIG. 15. The shaft member 431*b* moves above the second bifurcating members in FIG. 15, and moves to the fourth guide parts 444. The conveyed article mounting member 431 then gradually moves to the right of FIG. 1, and moves into proximity of the mounting member 31. When the conveyed article mounting member 431 moves into proximity of the mounting member 31, the first holding lever 422 is caused to rotate by the first holding lever protuberances 425, and the second holding lever 424 is caused to rotate by the second holding lever protuberances 426. When the first holding lever 422 and the second holding lever 424 rotate, the shirt supported on the mounting member 31 and the plurality of plate-shaped members 32 is held by the first holding lever 422 and the second holding lever 424. The conveyed article mounting member 431 moves along the first guide parts 441 while the shirt remains held in this manner. At this time, the first holding lever 422 is caused to rotate by the first holding lever protuberances 425 so as to separate from the shirt, and the second holding lever 424 is also caused to rotate by the second holding lever protuberances 426 so as to separate from the shirt. When the first holding rotating shaft 421 and the second holding rotating shaft 423 move to the position where the height position of the first guide parts 441 is lowest, the shaft member 431*b* moves toward the second guide parts 442 along the third guide parts 443. At this time, the first holding rotating shaft 421 and the second holding rotating shaft 423 move, and when these shafts 421, 423 reach the proximity of the first turning guide rotating shafts 445*a*, the first turning guide rotating shafts 445*a* change from the initial state in FIG. 12 to the state in FIG. 11. At this time, the shaft member 431*b* passes through the third guide parts 443 and moves toward the second guide parts 442. The conveyed article mounting member 431 then moves to the right of FIG. 1, and the holding contact lever 49 and the contact portions 448*h* of the fourth turning guide members 448 come in contact. The fourth turning guide members 448 are rotated, thereby changing from the state in FIG. 17 to the state in FIG. 15, and the conveyed article mounting member 431 moves to the stacking position.

The stacking operation will now be described.

When the conveyed article mounting member 431 moves to the stacking position (in proximity to the position where the height positions of the second guide parts 442 are lowest) and then moves away from the stacking position, a shirt is mounted on the stacking plate 51. After the first shirt is mounted, a second shirt is conveyed to the stacking position by repeating the folding and conveying operations described above, and the second shirt is stacked on the stacking plate 51. The folded shirts continue to be stacked sequentially in this manner. At this time, the springs 54 compress according to the weight of the shirts, and the height position of the stacking plate 51 is adjusted. The shirts or other articles stacked in this manner can then be taken out of the apparatus through an opening 21.

The cost can be suppressed because the configuration does not require a photoelectric sensor. The configuration of the mechanism for folding shirts and the like can be simplified, there being no need to provide a mechanism for moving the plate-shaped members for folding shirts and the like to the underside of the mounting member 31, the mechanism being provided below and to the side of the mounting member 31, and maintenance and repairs are easier.

Second Embodiment

1. Overall Configuration

Figure 26:
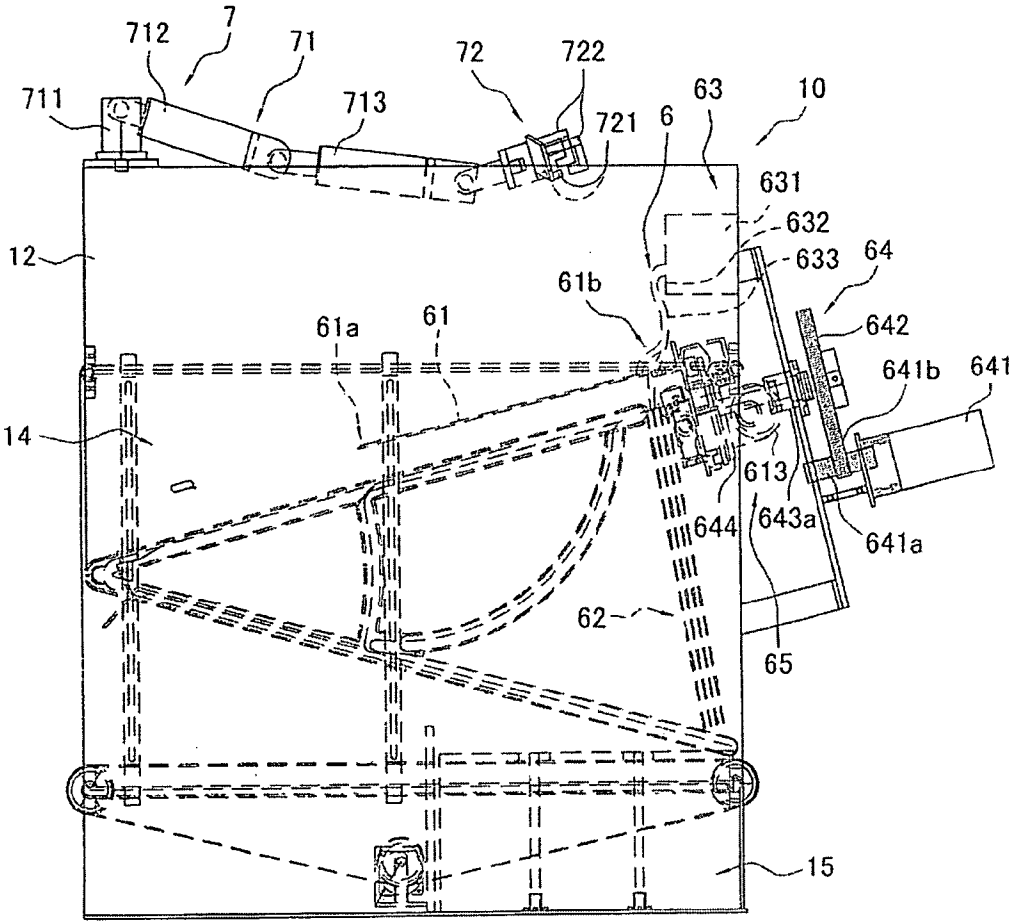
FIG. 26 is an overall view of the folding apparatus according to the second embodiment.

A folding apparatus 10 according to the second embodiment of the present invention is shown in FIG. 26. The folding apparatus 10 is an apparatus for folding foldable articles, e.g., shirts, towels, and the like, and the apparatus 10 comprises a frame 12, a folding part 6, a mounting device 7, a conveyor 14, and a stacking part 15. The frame 12, the conveyor 14, and the stacking part 15 of the folding apparatus 10 according to the second embodiment are configured identical to the folding apparatus 1 according to the first embodiment and are therefore not described.

2. Folding Part

The folding part 6 is a portion for folding shirts or the like as foldable articles, and the folding part 6 comprises a mounting member 61 (mounting member or plate member), a plurality of plate-shaped members 62, a steam supply device 63, a rotation mechanism 64, and a turning mechanism 65. The folding part 6 is placed at the top of the entire apparatus and is supported on the frame 12.

Figure 29:
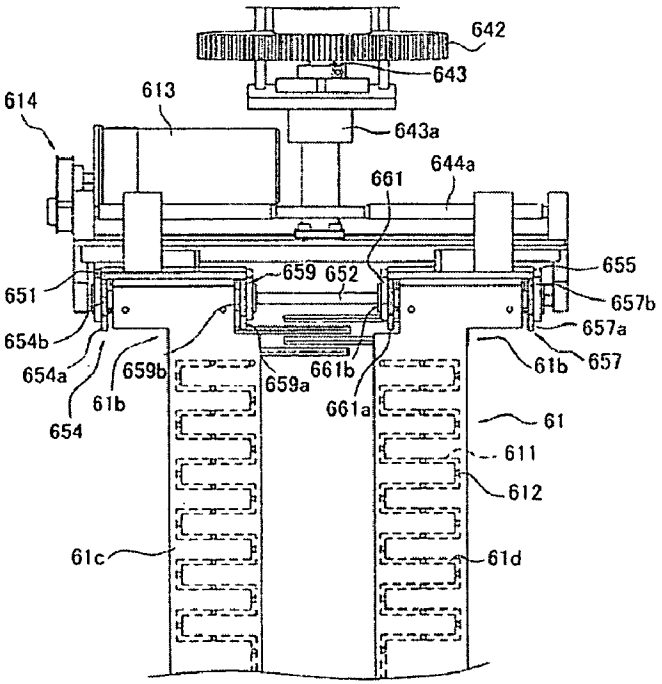
FIG. 29 is a view showing a state in which the first thin plate and second thin plate have moved apart from each other.
Figure 30:
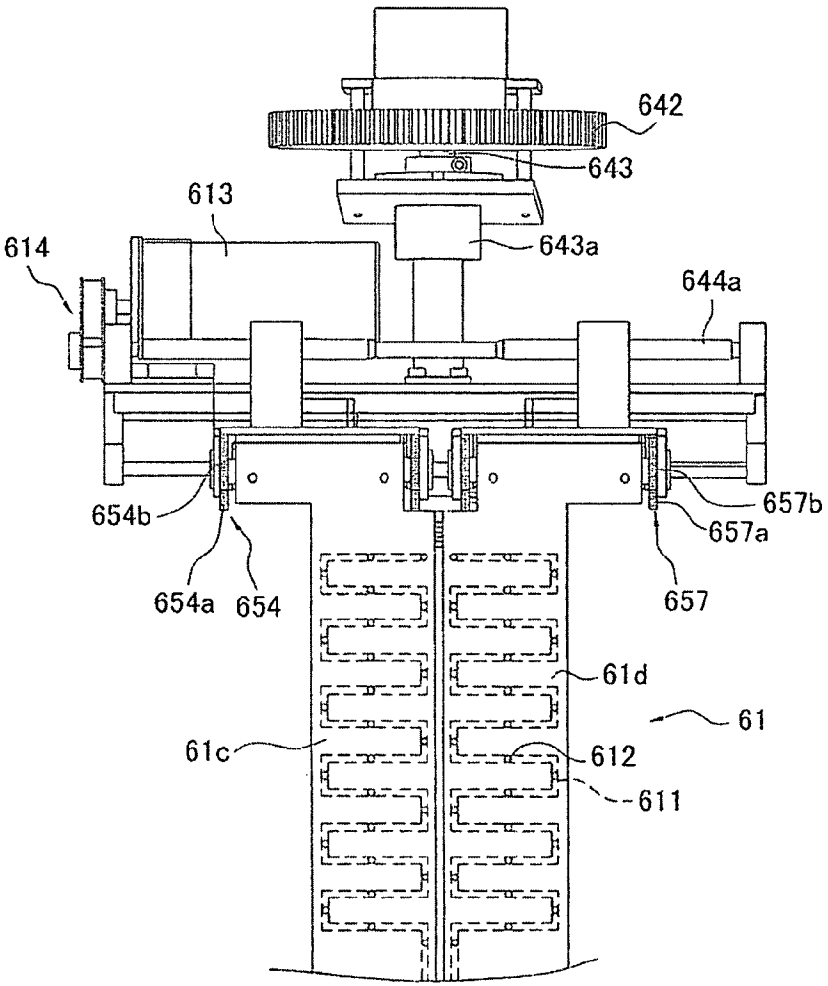
FIG. 30 is a view showing a state in which the first thin plate and second thin plate have come together.

The mounting member 61 is a member on which foldable articles such as shirts can be mounted, and is provided so that a first end 61*a* in the longitudinal direction is positioned at a lower position than a second end 61*b* opposite the first end 61*a*. Specifically, the mounting member 61 is placed at an incline of a predetermined angle and is attached to a base plate 644 of the rotation mechanism 64. The mounting member 61 has a first thin plate 61*c* and a second thin plate 61*d*, as shown in FIG. 29. The first thin plate 61*c* is a flat plate-shaped member extending in one direction, and formed throughout the entire interior is a flow channel 611 through which steam can pass. The first thin plate 61*c* is also provided with steam holes 612 for supplying steam from the flow channel 611 to the foldable articles. The second thin plate 61*d* is configured substantially identical to the first thin plate 61*c* and is disposed in parallel with the first thin plate 61*c*. A gap is formed between the first thin plate 61*c* and the second thin plate 61*d*. The first thin plate 61*c* and second thin plate 61*d* are capable of sliding relative to each other by a mounting member movement motor 613 or the like, described hereinafter.

The plurality of plate-shaped members 62 are members for folding the foldable articles in steps, and these members include a first plate-shaped member 621, a second plate-shaped member 622, a third plate-shaped member 623, and a fourth plate-shaped member 624. The plurality of plate-shaped members 62 are attached at one end to the vicinity of the second end 61*b* of the mounting member 61 so as to be capable of turning around one end.

Figure 27:
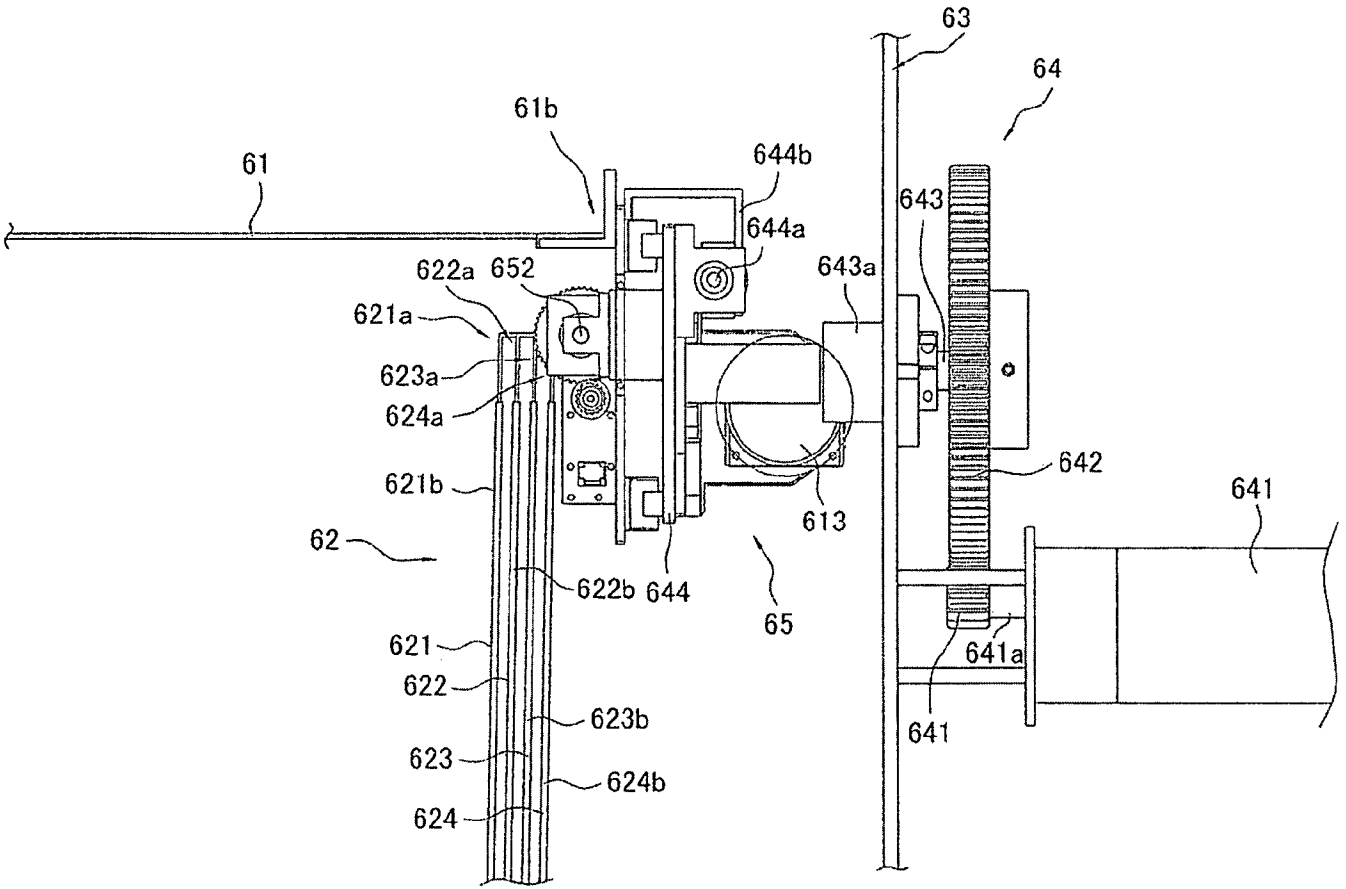
FIG. 27 is a side view of the folding part.
Figure 28:
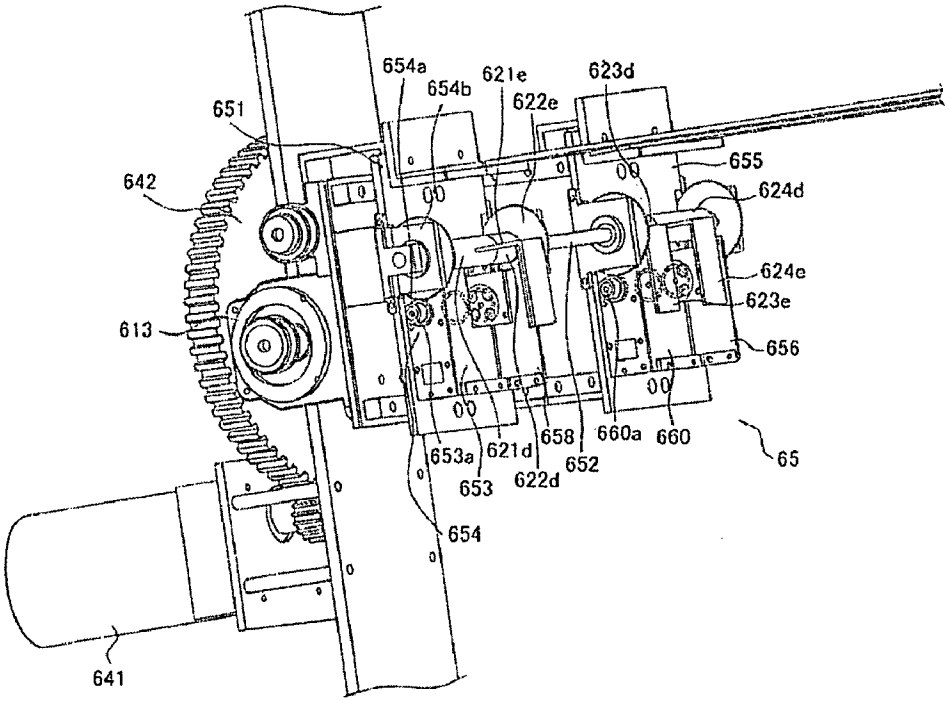
FIG. 28 is a view showing the turning mechanism and other components, excluding the plurality of plate-shaped members.

The first plate-shaped member 621 has a first connecting part 621*a* and a first holding plate-shaped part 621*b* as shown in FIG. 27, and the first plate-shaped member 621 is disposed in a direction substantially orthogonal to the direction in which the mounting member 61 extends while the foldable article has yet to be held between the mounting member 61 and the first plate-shaped member. The first connecting part 621*a* has a first cylindrical connecting part 621*d* in the shape of a cylinder, and a first connecting plate part 621*e* having a substantial L shape and protruding diametrically outward from the first cylindrical connecting part 621*d*, as shown in FIG. 28. A turning base shaft 652 (see FIG. 28), described hereinafter, for turning the first plate-shaped member 621 passes through the first cylindrical connecting part 621*d*. The first holding plate-shaped part 621*b* is a portion connected to the end of the first connecting part 621*a* on the side opposite where the first cylindrical connecting part 621*d* is placed, and is a plate-shaped member extending in a direction opposing the direction in which the first connecting part 621*a* is placed. The first holding plate-shaped part 621*b* is a plate-shaped portion having a greater width than the first and second thin plates 61*c*, 61*d*, and is placed at a position capable of being in contact with the first thin plate 61*c*. The first holding plate-shaped part 621*b* is a substantially rectangular portion, and part of the foldable article is held between the mounting member 61 or the second plate-shaped member 622 and the first holding plate-shaped part. Furthermore, similar to the first thin plate 61*c* and second thin plate 61*d*, formed inside the first holding plate-shaped part 621*b* are a flow channel (not shown) through which fluid or steam can pass, and steam holes (not shown) for supplying steam to the foldable article from the flow channel.

The second plate-shaped member 622 has a second connecting part 622*a* and a second holding plate-shaped part 622*b* as shown in FIG. 27, and the second plate-shaped member 622 is disposed so as to extend in a direction substantially orthogonal to the direction in which the mounting member 61 extends while the foldable article has yet to be folded. The second connecting part 622*a* has a second cylindrical connecting part 622*d* in the shape of a cylinder, and a second connecting plate part 622*e* having a substantial L shape and protruding diametrically outward from the second cylindrical connecting part 622*d*, as shown in FIG. 28. The turning base shaft 652, described hereinafter, for turning the second plate-shaped member 622 passes through the second cylindrical connecting part 622*d* (see FIG. 28). The second holding plate-shaped part 622*b* is a portion connected to the second cylindrical connecting part 622*d* of the second connecting part 622*a*, and is a plate-shaped portion extending in the direction opposite the direction in which the second cylindrical connecting part 622*d* of the second connecting part 622*a* is disposed. The second holding plate-shaped part 622*b* is a member having the same width as the first holding plate-shaped part 621*b*, and is superposed over the first plate-shaped member 621 at the end in the width direction. The second holding plate-shaped part 622*b* is a substantially rectangular portion, and part of the foldable article is held between the first plate-shaped member 621 or the third plate-shaped member 623 and the second holding plate-shaped part. Similar to the first thin plate 61*c* and second thin plate 61*d*, formed inside the second holding plate-shaped part 622*b* are a flow channel through which fluid or steam can pass, and steam holes for supplying steam to the foldable article from the flow channel.

The third plate-shaped member 623 has a third connecting part 623*a* and a third holding plate-shaped part 623*b*, and the third plate-shaped member 623 is disposed so as to extend in a direction substantially orthogonal to the direction in which the mounting member 61 extends while the foldable article has yet to be folded. The third connecting part 623*a* has a third cylindrical connecting part 623*d* in the shape of a cylinder, and a third connecting plate part 623*e* having a substantial L shape and protruding diametrically outward from the third cylindrical connecting part 623*d*, as shown in FIG. 28. The turning base shaft 652 (see FIG. 28), described hereinafter, for turning the third plate-shaped member 623 passes through the third cylindrical connecting part 623*d*. The third holding plate-shaped part 623*b* is a portion connected to the third connecting plate part 623*e*, and is a plate-shaped portion extending toward the opposite side of the third cylindrical connecting part 623*d*. The third holding plate-shaped part 623*b* is a member having substantially the same width as the first and second holding plate-shaped parts 621*b*, 622*b*, and is a member placed at the same position in the width direction as the first plate-shaped member 621. Furthermore, the third holding plate-shaped part 623*b* is a substantially rectangular portion, and foldable articles are held between the first plate-shaped member 621 and the third holding plate-shaped part. Similar to the first thin plate 61*c* and second thin plate 61*d*, formed inside the third holding plate-shaped part 623*b* are a flow channel through which fluid or steam can pass and steam holes for supplying steam to the foldable article from the flow channel.

The fourth plate-shaped member 624 has a fourth connecting part 624*a* and a fourth holding plate-shaped part 624*b*, and is disposed so as to extend in a direction substantially orthogonal to the direction in which the mounting member 61 extends while the foldable article has yet to be folded. The fourth connecting part 624*a* has a fourth cylindrical connecting part 624*d* in the shape of a cylinder, and a fourth connecting plate part 624*e* having a substantial L shape and protruding diametrically outward from the fourth cylindrical connecting part 624*d*, as shown in FIG. 28. The turning base shaft 652 (see FIG. 28), described hereinafter, for turning the fourth plate-shaped member 624 passes through the fourth cylindrical connecting part 624*d*. The fourth holding plate-shaped part 624*b* is a portion connected to the fourth connecting plate part 624*e*, and is a plate-shaped portion extending toward the opposite side of the fourth cylindrical connecting part 624*d*. The fourth holding plate-shaped part 624*b* is a member of substantially the same width as the first through third holding plate-shaped parts 621*b*, 622*b*, 623*b*, and is a member placed at the same position in the width direction as the second plate-shaped member 622. Furthermore, the fourth holding plate-shaped part 624*b* is a substantially rectangular portion, and foldable articles between the third plate-shaped member 623 and the fourth holding plate-shaped part 624. Similar to the first thin plate 61*c* and second thin plate 61*d*, formed inside the fourth holding plate-shaped part 624*b* are a flow channel through which fluid or steam can pass, and steam holes for supplying steam to the foldable article from the flow channel.

The plurality of plate-shaped members 62 are placed in alignment so that the ends of the first plate-shaped member 621, the second plate-shaped member 622, the third plate-shaped member 623, and the fourth plate-shaped member 624 overlap in the stated order, and during folding, the plate-shaped members 62 turn toward the mounting member 61 in the stated order.

The steam supply device 63 is a device for supplying steam to the flow channels in the mounting member 61 and the plurality of plate-shaped members 62, and this device has a fluid storage tank 631, a heater 632, and a feed tube 633, as shown in FIG. 26.

The fluid storage tank 631 is a container capable of storing fluid, and is placed above the rotation mechanism 64.

The heater 632 is a device for vaporizing the fluid stored in the fluid storage tank 631, and is placed between the fluid storage tank 631 and the feed tube 633.

The feed tube 633 is a member for feeding steam vaporized by the heater 632 to the flow channels of the mounting member 61 and the plurality of plate-shaped members 62, and is formed from a pliable material so as not to be severed or the like even when the mounting member 61 and the plurality of plate-shaped members 62 are caused to rotate a predetermined angle by the rotation mechanism 64.

The rotation mechanism 64 is a mechanism for rotating the mounting member 61 and the plurality of plate-shaped members 62 around an axis extending along the longitudinal direction of the mounting member 61, and is placed on the side of the mounting member 61 near the second end 61*b*. The rotation mechanism 64 has a rotation drive motor 641, a second transmission gear 642, a second transmission shaft 643, and a base plate 644, as shown in FIG. 26.

The rotation drive motor 641 is a member attached to the frame 12, and is also a member for generating power for rotating the mounting member 61 and the plurality of plate-shaped members 62. The rotation drive motor 641 is provided with a drive shaft 641*a*, and a first transmission gear 641*b* is attached to the drive shaft 641*a*. The second transmission gear 642 is a gear capable of meshing with the first transmission gear 641*b*, and is fixed to the second transmission shaft 643. Therefore, the rotation of the second transmission gear 642 causes power to be transmitted to the second transmission shaft 643, and the second transmission shaft 643 rotates. The second transmission shaft 643 is rotatably attached to the frame 12 via a bearing 643*a*, and the base plate 644 is attached to the distal end of the second transmission shaft 643.

The base plate 644 is a plate-shaped member attached to the distal end of the second transmission shaft 643, and is a member caused to rotate according to the rotation of the drive shaft 641*a*.

A pair of base shafts 644*a* having spiral grooves formed in the outer surfaces are attached to the base plate 644, a pair of substantially cubic attachment members 644*b* are attached to the base shafts 644*a*, and the first thin plate 61*c* and second thin plate 61*d* are respectively attached to the attachment members 644*b*. The mounting member movement motor 613 is provided on the base plate 644, and the mounting member movement motor 613 is capable of transmitting power to the base shafts 644*a* via a mounting member movement gear train 614 (see FIG. 29). The rotation of the base shafts 644*a* causes the first thin plate 61*c* and the second thin plate 61*d* to move either toward or away from each other.

The turning mechanism 65 is a mechanism for turning the plurality of plate-shaped members 62 toward the mounting member 61, and is placed in proximity to the second end 61*b* of the mounting member 61, as shown in FIG. 27. The turning mechanism 65 also has a first turning base plate 651, a turning base shaft 652, a first drive motor 653, a first turning gear train 654, a second turning base plate 655, a second drive motor 656, a second turning gear train 657, a third drive motor 658, a third turning gear train 659, a fourth drive motor 660, and a fourth turning gear train 661, as shown in FIG. 28.

The first turning base plate 651 is a plate-shaped member attached to the first thin plate 61*c* in a substantially perpendicular manner, and is attached to the base plate 644 so as to be capable of sliding in the longitudinal direction. Therefore, the first turning base plate 651 also moves according to the movement of the first thin plate 61*c*.

The turning base shaft 652 is a shaft-shaped member extending along the second end 61*b* of the mounting member 61 in proximity to the second end 61*b*. The first through fourth plate-shaped members 621, 622, 623, 624 are attached to the turning base shaft 652.

The first drive motor 653 is a member attached to the first turning base plate 651, and is a device for turning the first plate-shaped member 621. The first drive motor 653 has a first drive shaft 653*a* protruding outward.

The first turning gear train 654 has a first drive shaft gear 654*a* attached to the first drive shaft 653*a*, and a first base shaft gear 654*b* attached to the turning base shaft 652 and meshed with the first drive shaft gear 654*a*. The first base shaft gear 654*b* is fixed to the first plate-shaped member 62*i*, and the first plate-shaped member 621 turns according to the rotation of the first base shaft gear 654*b*. The power from the first drive motor 653 is transmitted to the first base shaft gear 654*b* via the first drive shaft gear 654*a*, and the turning base shaft 652 is caused to rotate.

The second turning base plate 655 is a plate-shaped member provided to the second thin plate 61*d* in a substantially perpendicular manner, and is attached to the base plate 644 to be capable of sliding in the longitudinal direction. Therefore, the second turning base plate 655 also moves according to the movement of the second thin plate 61*d*.

The second drive motor 656 is a motor for turning the second plate-shaped member 622, and is a member attached to the second turning base plate 655. The second drive motor 656 has a second drive shaft (not shown) protruding outward.

The second turning gear train 657 is a portion for transmitting power from the second drive motor 656 to the second plate-shaped member 622, and the second turning gear train 657 has a second drive shaft gear 657*a* attached to the second drive shaft, and a second turning shaft gear 657*b* capable of meshing with the second drive shaft gear 657*a* and attached to the second plate-shaped member 622, as shown in FIG. 29. The second plate-shaped member 622 also turns according to the rotation of the second turning shaft gear 657*b*.

The third drive motor 658 is a motor for turning the third plate-shaped member 623, and is placed on the first turning base plate 651 in alignment with the first drive motor 653. The third drive motor 658 also has a third drive shaft (not shown) protruding outward.

The third turning gear train 659 is a portion for transmitting power from the third drive motor 658 to the third plate-shaped member 623, and the third turning gear train 659 has a third drive shaft gear 659*a* attached to the third drive shaft (not shown), and a third turning shaft gear 659*b* capable of meshing with the third drive shaft gear 659*a* and attached to the third plate-shaped member 623. The third plate-shaped member 623 also turns according to the rotation of the third turning shaft gear 659*b*.

The fourth drive motor 660 is a motor for turning the fourth plate-shaped member 624, and is placed on the second turning base plate 655 in alignment with the second drive motor 656. The fourth drive motor 660 also has a fourth drive shaft 660*a* protruding outward.

The fourth turning gear train 661 is a portion for transmitting power from the fourth drive motor 660 to the fourth plate-shaped member 624, and the fourth turning gear train 661 has a fourth drive shaft gear 661*a* attached to the fourth drive shaft 660*a*, and a fourth turning shaft gear 661*b* capable of meshing with the fourth drive shaft gear 661*a* and attached to the fourth plate-shaped member 624. The rotation of the fourth turning shaft gear 661*b* causes the fourth plate-shaped member 624 to turn.

3. Mounting Device

Figure 31:
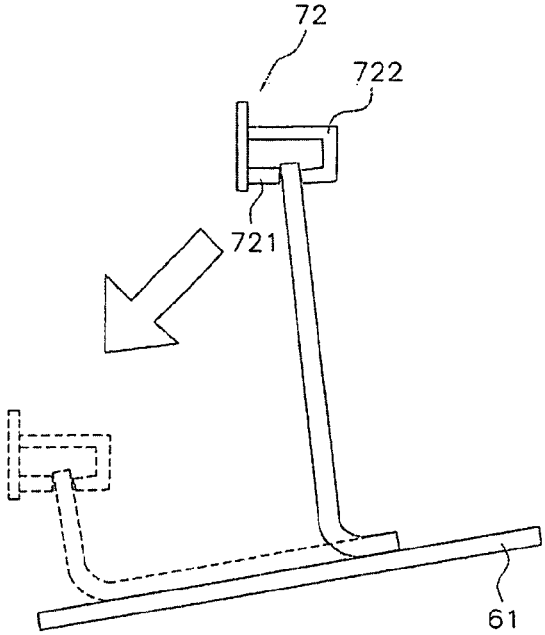
FIG. 31 is a view schematically depicting the movement of the gripper hand when a foldable article is mounted on the mounting member.

The mounting device 7 is a device for mounting foldable articles on the mounting member 61, and is placed above the folding part 6, as shown in FIG. 26. The mounting device 7 comprises a gripper arm 71 and a gripper hand 72. The gripper arm 71 has an arm connecting part 711, a first arm part 712, and a second arm part 713. The arm connecting part 711 is a part for attaching the mounting device 7 to the frame 12, and is attached to the top side of the frame 12. The first arm part 712 is turnably attached at one end to the arm connecting part 711, and is a substantially columnar portion. The second arm part 713 is a substantially columnar portion, attached to the other end of the first arm part 712 and capable of turning relative to the first arm part 712. The gripper hand 72 is a member capable of gripping foldable articles, and is attached to the distal end of the second arm part 713. The gripper hand 72 is capable of turning relative to the second arm part 713, and the gripper hand 72 has a pair of first holding parts 721 and a pair of second holding parts 722. The first holding parts 721 are portions in which foldable articles are held between the second holding parts 722 and the first holding parts 721, and are placed apart from each other at a predetermined distance so as to be capable of holding foldable articles in a stretched state so that wrinkles do not form. The first holding parts 721 are placed so as to face the second holding parts 722. The second holding parts 722 are portions bent into substantial L shapes, and are also portions capable of moving toward the first holding parts 721. The pair of second holding parts 722 are also placed apart from each other at the same predetermined distance as the first holding parts 721. The gripper hand 72 is moved according to the deformation of the gripper arm 71 so that the hand's height position is gradually lowered from above the second end 61*b* of the mounting member 61 toward the first end 61*a*, as shown in FIG. 31. When the gripper hand 72 moves from the second end 61*b* toward the first end 61*a* in this manner, a foldable article is mounted on the mounting member 61.

4. Operation

Operations other than the folding operation, i.e., the conveying operation and the stacking operation are identical to the first embodiment and are therefore not described. The following is a description of the mounting operation for mounting a foldable article on the mounting member 61, and the folding operation for folding a foldable article.

First, a shirt is mounted on the mounting member 61 by the mounting device 7. Specifically, a shirt is held in a stretched state between the pair of first holding parts 721 and the pair of second holding parts 722 of the gripper hand 72, and the gripper hand 72 moves while lowering in height from the second end 61*b* of the mounting member 61 toward the first end 61*a*, as shown in FIG. 31, according to the turning and movement of the first arm part 712 and second arm part 713. The shirt is mounted on the mounting member 61 without creasing according to the movement of the gripper hand 72.

When the shirt, being the foldable article, is mounted on the mounting member 61, the mounting member 61 is caused to rotate counterclockwise by the rotation drive motor 641. Specifically, the mounting member 61 is caused to rotate 90° or more, or substantially 100°. This rotation causes part of the shirt mounted on the mounting member 61, including the sleeve portion on one side, to be positioned in the vicinity of the surface of the mounting member 61 on the side opposite where the shirt is placed. In this state, the first plate-shaped member 621 is caused to turn toward the mounting member 61 by the first drive motor 653, and part of the shirt including the sleeve portion on one side is held between the mounting member 61 and the first plate-shaped member 621. The mounting member 61 is then caused to rotate substantially 180° clockwise by the rotation drive motor 641. In this state, the second plate-shaped member 622 is caused to turn toward the mounting member 61 by the second drive motor 656, and part of the shirt including the sleeve portion on the other side is held between the second plate-shaped member 622 and the first plate-shaped member 621. From this state, the mounting member 61 is caused to further rotate 180° counterclockwise, and the third plate-shaped member 623 is turned toward the mounting member 61. Part of the shirt is then held between the third plate-shaped member 623 and the second plate-shaped members 622. Thus, the shirt is folded by the mounting member 61 and the plurality of plate-shaped members 62. From this state, the mounting member 61 is further caused to rotate 180° clockwise, and the fourth plate-shaped member 624 is caused to turn toward the mounting member 61. Part of the shirt is then held between the fourth plate-shaped member 624 and the third plate-shaped members 623. Thus, the shirt is folded by the mounting member 61 and the plurality of plate-shaped members 62. The third plate-shaped member 623 and the fourth plate-shaped member 624 do not need to be used when folding a half-sleeve shirt or the like.

Since the mounting member 61 is caused to rotate 90° or more by the rotation drive motor 641, wrinkles do not readily form when part of the shirt including a sleeve is held between the mounting member 61 and the plurality of plate-shaped member 62.

Furthermore, the flow channel 611 and steam holes 612 are formed in the plurality of plate-shaped members 62 and the mounting member 61, steam is supplied to the foldable articles, and the foldable articles are heated, whereby wrinkles can be smoothed out. Therefore, foldable articles can be folded in a presentable manner.

Foldable articles of various sizes can be folded, because the width of the mounting member 61 can be adjusted and the positions of the plurality of plate-shaped members 62 can be adjusted.

Other Embodiments (a) In the embodiments described above, cases of three or four plate-shaped members 32 were described, but the present invention is not limited to these options alone, and two plate-shaped members or five or more plate-shaped members are also possible options. Cases of the foldable articles being shirts were also described, but towels, pants, and other articles may also be used.

(b) In the embodiments described above, the plurality of plate-shaped members 32 were turned and moved toward the mounting member 31, but the present invention is not limited to this option alone, and another possible option is to slide and move the plurality of plate-shaped members in parallel toward the mounting member 31 while the plurality of plate-shaped members are parallel to the mounting member 31, the plurality of plate-shaped members being placed parallel to the surface of the mounting member 31 on the side opposite where the shirts or the like are placed.

(c) In the embodiments described above, the mounting member 31 and other components were turned clockwise after the third plate-shaped member 323 was turned toward the mounting member 31, but the present invention is not limited to this option alone, and the components may be rotated counterclockwise.

(d) In the embodiments described above, the mounting member and the plurality of plate-shaped members were driven by one motor, but the present invention is not limited to this option alone, and the shaft of the motor may be rotated manually.

(e) In the embodiments described above, the conveyed article mounting member 431 was caused to approach the mounting member 31 by the fourth guide parts 444 so as to turn toward the mounting member 31 from below, but the present invention is not limited to this option alone, and another possible option is to move the conveyed article mounting member 431 into proximity of the mounting member 31 by moving the conveyed article mounting member 431 from the ends of the first guide parts 441 on the side opposite where the rotation mechanism 33 is placed toward the ends on the side where the rotation mechanism 33 is placed. In this case, part of the shirt or the like is folded according to the movement of the conveyed article mounting member 431.

Figure 32:
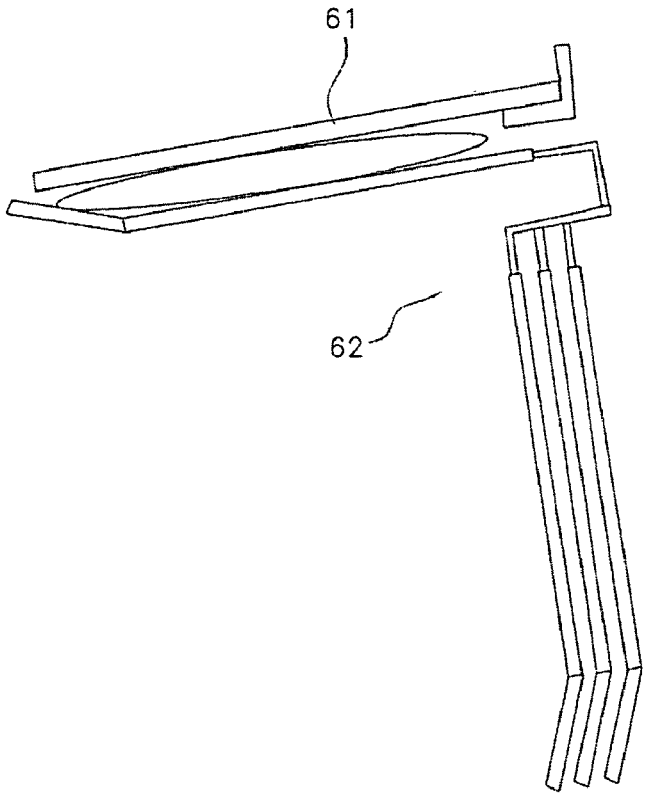
FIG. 32 is a view showing the plurality of plate-shaped members according to another embodiment.
Figure 33:
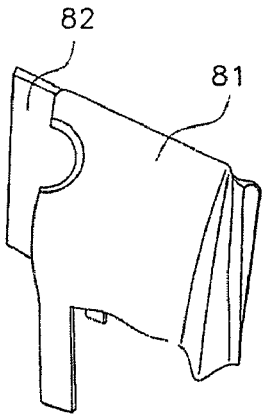
FIG. 33 is a view showing a shirt in a case in which the rotational angle of the mounting member is 90° or less.
Figure 34:
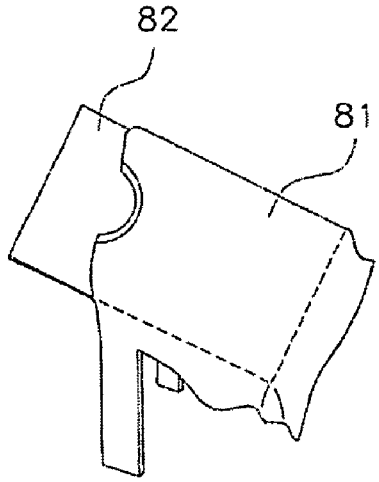
FIG. 34 is a view showing a shirt in a case in which the rotational angle of the mounting member is 90° or greater.
Figure 35:
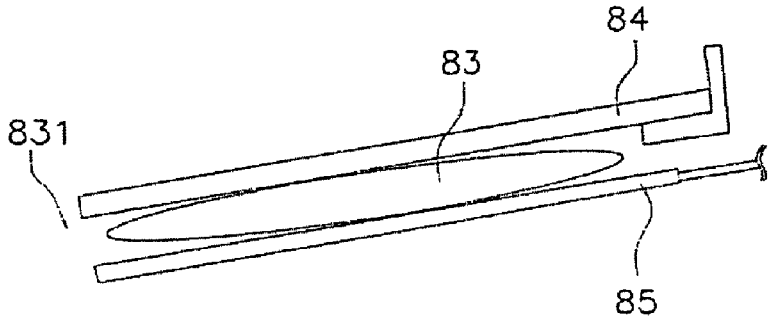
FIG. 35 is a view showing a state in which the foldable article is held by the mounting member (plate member) and a plate-shaped member in the case of a thick foldable article.

(f) In the embodiments described above, the plurality of plate-shaped members 62 were all flat plate-shaped members, but the present invention is not limited to this option alone, and the plate-shaped members may be bent in the direction in which the plate-shaped members can turn, as shown in FIG. 32. In this case, the distal ends of the plurality of plate-shaped members 62 are bent so as to approach the mounting member 61 when the distal ends have been turned, and the foldable articles can therefore be firmly held in the vicinities of the distal ends.

(g) In the second embodiment, steam was supplied and heat was generated by the steam and steam holes in the flow channels, but another possible option is to place nichrome wire or the like inside the mounting member 61 and the plurality of plate-shaped members 62 to generate heat in the mounting member 61 and the plurality of plate-shaped members 62.

(h) In the second embodiment described above, a gripper hand 72 having a pair of first holding parts 721 and a pair of second holding parts 722 was used, but the present invention is not limited to this option alone, and another possible option is to use first holding parts and second holding parts of a predetermined length capable of gripping one end of a foldable article while the foldable article is being stretched.

What is claimed is:

1. A folding apparatus comprising:

a mounting member on which a foldable article can be mounted on a first surface so that part of the foldable article hangs down;

a rotation mechanism for rotating the first surface of the mounting member around an axis included in the first surface; and a plurality of plate-shaped members capable of moving toward the mounting member so as to hold part of the foldable article, after part of the foldable article has been positioned in proximity to the surface of the mounting member on the side opposite the surface where the foldable article is mounted, by the rotation of the mounting member via the rotation mechanism.

2. The folding apparatus as recited in claim 1, wherein the plurality of plate-shaped members are turnably fixed at one end to the mounting member; and the folding apparatus further comprises a turning mechanism for turning the plate-shaped members toward the mounting member at a predetermined timing.

3. The folding apparatus as recited in claim 2, wherein turning angle of the plurality of plate-shaped members in relation to the mounting member is 90° or less.

4. The folding apparatus as recited in any of claim 1, further comprising a conveying apparatus having:

a holding mechanism for holding a folded article as a foldable article that has been folded; and a folded article movement mechanism for conveying the folded article held by the holding mechanism from the mounting member to a predetermined position.

5. A folding apparatus comprising:

a flat plate member;

a rotation mechanism for rotating a first surface of the plate member around an axis included in the first surface, the rotation mechanism being placed at an end of the plate member;

a plurality of plate-shaped members rotated by the rotation mechanism and attached in the vicinity of the lateral end of the plate member where the rotation mechanism is placed, the plurality of plate-shaped members being capable of turning relative to the plate member; and a turning mechanism for turning the plurality of plate-shaped members relative to the plate member.

6. The folding apparatus as recited in claim 5, wherein the rotation mechanism and the turning mechanism are operated by a single drive source.

7. The folding apparatus as recited in claim 6, wherein the turning mechanism turns the plurality of plate-shaped members at a turning angle of 90° or less relative to the plate member.

8. The folding apparatus as recited in claim 5, wherein the plurality of plate-shaped members are turnably connected at one end to an end of the plate member.

9. The folding apparatus as recited in claim 5, further comprising:

a conveying apparatus including a holding mechanism having a first holding member placed below the folded article, a second holding member placed above the folded article so as to face the first holding member, the second holding member and the first holding member being capable of holding the folded article therebetween, and a holding member movement mechanism for moving the first holding member and the second holding member toward the folded article, and further including a folded article movement mechanism for moving the folded article to the predetermined position; and a stacking device for stacking the folded article conveyed by the conveying apparatus.

10. The folding apparatus as recited in claim 9, wherein the plate member and the plurality of plate-shaped members comprise cutouts through which at least one of the first holding member and the second holding member can pass when the plate member and the plurality of plate-shaped members are superposed together.

11. The folding apparatus as recited in claim 9, wherein the stacking device has a stacking structure whose height position varies according to the weight of the folded article.

12. The folding apparatus as recited in claim 9, wherein the folded article movement mechanism has:

a plate-shaped folded article mounting member on which the folded articles can be mounted;

rod-shaped members attached to both ends of the folded article mounting member, the rod-shaped members being longer than the width of the folded article mounting member; and guide members for guiding the rod-shaped members so that the folded article mounting member moves between a mounting position where the folded articles are mounted on the folded article mounting member, and a stacking position where the folded articles mounted on the folded article mounting member are stacked at a predetermined position.

13. The folding apparatus as recited in claim 1, further comprising a conveying apparatus that includes:

a first holding member placed below the foldable article;

a second holding member placed above the foldable article so as to face the first holding member, the second holding member and the first holding member being capable of holding the foldable article therebetween;

a holding member movement mechanism for moving the first holding member and the second holding member toward the foldable article; and a conveyed article movement mechanism for moving the foldable article to a predetermined position.

14. A folding method comprising:

a first step for mounting a foldable article on a plate-shaped mounting member on which the foldable article can be mounted;

a second step for rotating the mounting member and thereby positioning a first folded part in the vicinity of the surface of the mounting member on the side where the foldable article is not mounted, the first folded part being part of the foldable article mounted on the mounting member;

a third step for moving a flat first plate-shaped member so as to hold the first folded part between the mounting member and the flat first plate-shaped member;

a fourth step for rotating the mounting member and thereby positioning a second folded part in the vicinity of the surface of the first plate-shaped member on the side opposite the mounting member, the second folded part being a different part of the foldable article than the first folded part;

a fifth step for moving a flat second plate-shaped member so as to hold the second folded part between the first plate-shaped member and the flat second plate-shaped member;

a sixth step for rotating the mounting member and thereby positioning a third folded part in the vicinity of the surface of the second plate-shaped member on the side opposite the first plate-shaped member, the third folded part being a different part of the foldable article than the first folded part and the second folded part; and a seventh step for moving a flat third plate-shaped member so as to hold the third folded part between the second plate-shaped member and the flat third plate-shaped member.

15. The folding method as recited in claim 14, wherein the mounting member is turned 90° or more in the second step, the fourth step, and the sixth step, thereby positioning the folded part in the vicinity of the surface of the mounting member on the side where the foldable article is not placed, the folded part being part of the foldable article mounted on the mounting member.

16. The folding apparatus as recited in any of claims 1 through 4, wherein the width of the mounting member can be adjusted according to the shape of the foldable article; and the positions of the plurality of plate-shaped members can be adjusted according to the shape of the foldable article.

17. The folding apparatus as recited in claim 1, wherein the mounting member and the plurality of plate-shaped members are capable of generating heat and supplying steam to the foldable article.

18. The folding apparatus as recited in claim 1, wherein the plurality of plate-shaped members are placed at a predetermined distance away from the mounting member, and are bent so as to hold the foldable article from the distal end sides between the mounting member and the plurality of plate-shaped members.

19. The folding apparatus as recited in any of claims 5 through 12, wherein the width of the plate member can be adjusted according to the shape of the foldable article; and the positions of the plurality of plate-shaped members can be adjusted according to the shape of the foldable article.

20. The folding apparatus as recited in any of claims 5 through 12, wherein the plate member and the plurality of plate-shaped members are capable of generating heat and supplying steam to the foldable article.

21. The folding apparatus as recited in any of claims 5 through 12, wherein the plurality of plate-shaped members are placed at a predetermined distance away from the plate member, and are bent so as to hold the foldable article from the distal end sides between the plate member and the plate-shaped members.

22. The folding apparatus as recited in any of claims 1 through 12, wherein the plurality of plate-shaped members can be elastically deformed.

23. The folding apparatus as recited in claim 1, further comprising a mounting apparatus for setting the foldable article on the mounting member on which foldable articles can be mounted; the mounting apparatus comprising:

a gripping member for gripping one end of the foldable article; wherein the gripping member mounts the foldable article on the mounting member by advancing in one direction while gradually moving from the space above the mounting member to the space below.

* * * * *